US010895838B2

(12) United States Patent
Matsumoto et al.

(10) Patent No.: US 10,895,838 B2
(45) Date of Patent: Jan. 19, 2021

(54) IMAGE FORMING APPARATUS

(71) Applicant: CANON KABUSHIKI KAISHA, Tokyo (JP)

(72) Inventors: Hidenori Matsumoto, Kashiwa (JP); Yousuke Hata, Ichikawa (JP); Masahiro Shinotsuka, Sashima-gun (JP); Tatsuya Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/452,729

(22) Filed: Jun. 26, 2019

(65) Prior Publication Data

US 2020/0004188 A1 Jan. 2, 2020

(30) Foreign Application Priority Data

Jul. 2, 2018 (JP) ..... 2018-126241

(51) Int. Cl.
*G03G 21/16* (2006.01)
*G03G 15/00* (2006.01)

(52) U.S. Cl.
CPC ..... *G03G 15/5016* (2013.01); *G03G 21/1633* (2013.01); *G03G 21/16* (2013.01)

(58) Field of Classification Search
CPC ..... G03G 21/1633; G03G 21/1875; G03G 21/1878; G03G 21/1892; G03G 21/1657
See application file for complete search history.

(56) References Cited

U.S. PATENT DOCUMENTS

| | | | | |
|---|---|---|---|---|
| 4,937,626 | A | 6/1990 | Kohtani et al. | |
| 7,035,562 | B1 | 4/2006 | Suzuki et al. | |
| 7,228,078 | B2 | 6/2007 | Okochi | |
| 8,019,240 | B2 | 9/2011 | Kakuta et al. | |
| 9,229,423 | B2 * | 1/2016 | Iikura | G03G 21/1676 |
| 2018/0181059 | A1 * | 6/2018 | Uemura | G03G 21/1657 |

FOREIGN PATENT DOCUMENTS

JP 2006071905 A * 3/2006 ..... G03G 15/502

OTHER PUBLICATIONS

Okochi, JP 2006-071905 A, Mar. 2006, JPO Computer Translation (Year: 2006).*

* cited by examiner

*Primary Examiner* — Erika J Villaluna
(74) *Attorney, Agent, or Firm* — Venable LLP

(57) ABSTRACT

An image forming apparatus includes a mounting unit to which a developer container is mounted, a controller to control a motor to rotate the mounted container, and a sensor to detect a predetermined portion in which the mounted container is rotated. The controller determines whether the container is mounted based on the detection result of the sensor, wherein the controller controls the motor based on the detection result so that a rotation speed of the mounted container is equal to a predetermined rotation speed. After a door is opened, in a case where, while communication between a communication unit and a memory is maintained, a detection result of the sensor is changed from a first detection result in which the predetermined portion is detected to a second detection result in which the predetermined portion is not detected, the controller determines the mounted container has been manually rotated.

10 Claims, 13 Drawing Sheets

△ THE TONER CONTAINER OF THE COLOR THAT CAN BE USED CONTINUOUSLY HAS BEEN REMOVED.

・YELLOW

SET AGAIN THE REMOVED TONER CONTAINER.
THANK YOU FOR YOUR COOPERATION FOR THE EFFECTIVE USE OF LIMITED RESOURCES.

FIG. 10A

△ THE FOLLOWING TONER CONTAINER HAS BEEN REMOVED WITH SOME TONER STILL LEFT. PERFPRM RESTORATION OPERATION.

・YELLOE

RESTORATION OPERATION :
REMOVE THE TONER CONTAINER OF THE ABOVE COLOR. THEN, SET AGAIN THE TONER CONTAINER THAT WAS SET BEFORE THE REPLACEMENT.

FIG. 10B

△ NO TONER BOTTLE IS SET.
PLEASE SET A TONER BOTTLE.

FIG. 10C

| PREVIOUS VALUE | PRESENT VALUE | COMMUNICATION STATE | MOUNTED STATE | WARNING SCREEN |
|---|---|---|---|---|
| LOW LEVEL | LOW LEVEL | DISABLE | REMOVED | DISPLAYED |
| LOW LEVEL | LOW LEVEL | ENABLE | MOUNTED | HIDDEN |
| LOW LEVEL | HIGH LEVEL | — | MOUNTED | HIDDEN |
| HIGH LEVEL | LOW LEVEL | DISABLE | REMOVED | DISPLAYED |
| HIGH LEVEL | LOW LEVEL | ENABLE | ROTATED | HIDDEN |
| HIGH LEVEL | HIGH LEVEL | — | MOUNTED | HIDDEN |

FIG. 12

IMAGE FORMING APPARATUS

BACKGROUND OF THE INVENTION

Field of the Invention

The present disclosure relates to an image forming apparatus configured to form an image through use of a developer, and more particularly, to an image forming apparatus to which a container configured to contain a developer is attachably and detachably provided.

Description of the Related Art

An electrophotographic image forming apparatus forms an image by developing an electrostatic latent image formed on a photosensitive member through use of a developer in a developing device. The developing device has a limit to an amount of a developer that can be stored therein. Therefore, a container configured to contain a developer is used to replenish the developing device with a developer. The container is attachably and detachably provided to the image forming apparatus. The image forming apparatus appropriately replenishes the developing device with a developer from the mounted container by rotating the container. An amount of a developer to be supplied to the developing device from the container changes depending on a rotation state of the container. A technology for controlling rotation of the container based on a rotation amount of the container is being investigated in order to appropriately control the amount of the developer to be supplied. There is also a limit to the amount of a developer that can be contained in the container. When there is no developer remaining in the container, the developing device cannot be replenished with a developer from the container. In that case, the image forming apparatus notifies a user that the container requires replacement.

The user sometimes replaces the container even when there is a developer having an amount equal to or larger than a predetermined amount remaining in the container. There is proposed an image forming apparatus configured to display, in such a case, a screen for warning that there is a developer remaining in the container (U.S. Pat. No. 7,228,078 (B2)). The image forming apparatus notifies the user that the container is usable, to thereby suppress unnecessary replacement of the container in which a developer remains.

There is also known a method of detecting removal of a container through use of a sensor (hereinafter referred to as "rotation detection sensor") configured to detect the rotation of the container. This is a method utilizing the fact that a detection result obtained by the rotation detection sensor for the container changes when the container is removed. For example, the detection result obtained by the rotation detection sensor is a high level when the container is mounted, and the detection result obtained by the rotation detection sensor is a low level when the container is removed. A mounted state of the container is detected based on such a change in output signal indicating the detection result obtained by the rotation detection sensor.

In a case where the rotation detection sensor is used to detect the mounted state of the container, the detection result obtained by the rotation detection sensor may change even when, for example, the user manually rotates the container, to thereby cause the mounted state of the container to be erroneously detected. Such erroneous detection causes unnecessary warning display to be presented to the user irrespective of the mounted container. The present disclosure has an object to provide an image forming apparatus configured to suppress unnecessary warning display due to erroneous detection of a mounted state of a container.

SUMMARY OF THE INVENTION

An image forming apparatus according to the present disclosure includes: an image forming unit configured to form an image by using a developer; a mounting unit to which a container is to be mounted, wherein the container in which a developer is contained; a door, wherein the door is to be opened to mount the container to the mounting unit or remove the mounted container from the mounting unit; a motor; a controller configured to control the motor to rotate the container mounted to the mounting unit; a sensor configured to detect a predetermined portion in a rotation direction in which the mounted container is rotated; and a communication unit configured to communicate with a memory of the container mounted to the mounting unit, wherein the controller, after the mounted container is rotated, controls the motor so that the predetermined portion is detected by the sensor when a rotation of the mounted container is stopped, wherein, in a case where the door is closed, the controller determines, based on a detection result of the sensor, that the container mounted to the mounting unit, wherein, in a case where the door is opened, the controller determines, based on a communication condition of the communication unit, that the mounted container removed from the mounting unit.

Further features of the present invention will become apparent from the following description of exemplary embodiments (with reference to the attached drawings).

BRIEF DESCRIPTION OF THE DRAWINGS

FIG. 10A, FIG. 10B, and FIG. 10C are diagrams for illustrating examples of a screen to be displayed on a display.

FIG. 12 is an explanatory table for showing a display state of the warning screen.

DESCRIPTION OF THE EMBODIMENTS

Now, at least one embodiment of the present disclosure is described in detail with reference to the accompanying drawings.

Image Forming Apparatus

Figure 1:
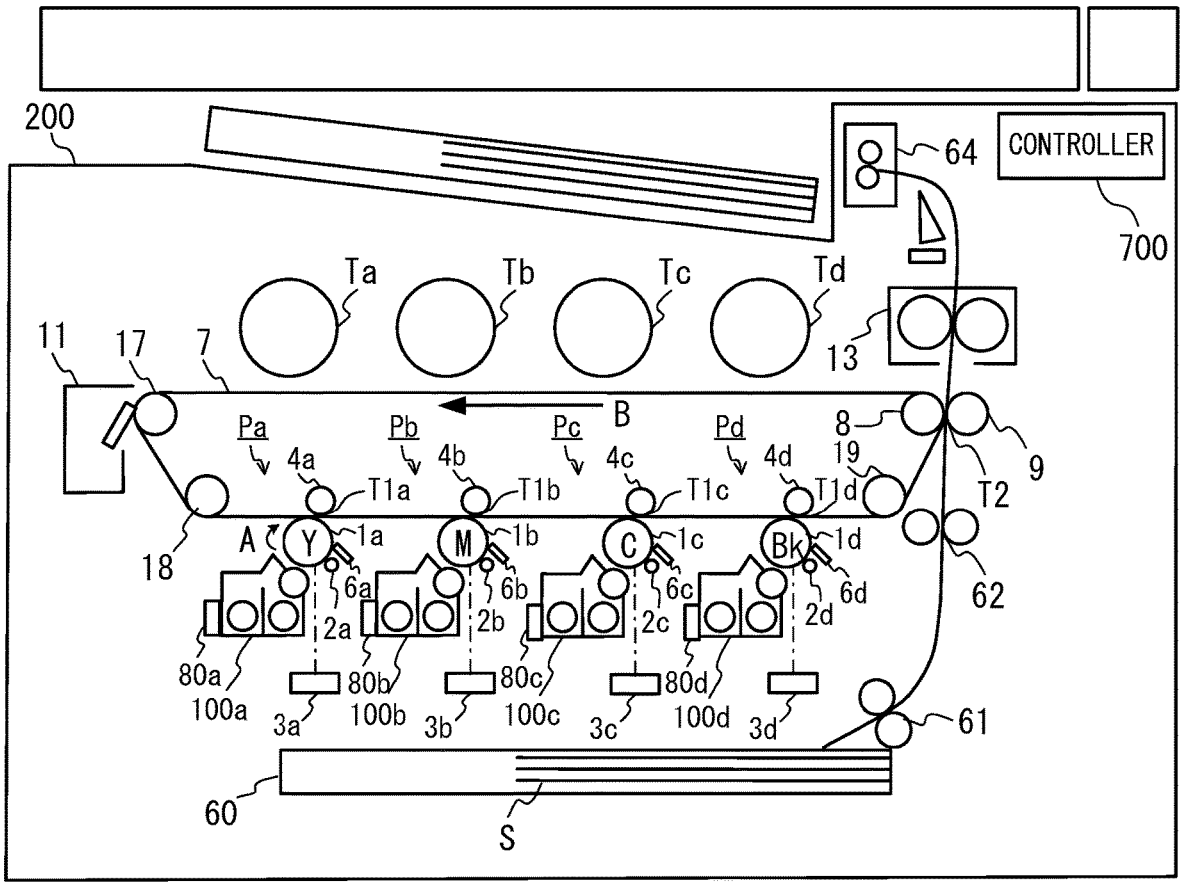
FIG. 1 is a configuration diagram of an image forming apparatus according to at least one embodiment of the present disclosure.

FIG. 1 is a configuration diagram of an image forming apparatus 200. The image forming apparatus 200 includes four image formers Pa, Pb, Pc, and Pd configured to form toner images of different color components, which are arranged side by side in a rotation direction of an intermediate transfer belt 7. The image former Pa forms a toner image of yellow being a chromatic color. The image former Pb forms a toner image of magenta being a chromatic color. The image former Pc forms a toner image of cyan being a chromatic color. The image former Pd forms a toner image of black being an achromatic color. In the image forming apparatus 200, toner bottles Ta, Tb, Tc, and Td each being a container configured to contain toner as a developer are attachably and detachably mounted. The toner bottle Ta contains the toner of yellow. The toner bottle Tb contains the toner of magenta. The toner bottle Tc contains the toner of cyan. The toner bottle Td contains the toner of black. The toner bottles Ta, Tb, Tc, and Td each supply the toner being the developer to a developing device of the image former configured to form the toner image of the corresponding color.

The image formers Pa, Pb, Pc, and Pd have the same configuration. The following description is directed to the image former Pa configured to form the toner image of yellow, and descriptions relating to the configurations of the other image formers Pb, Pc, and Pd are omitted.

The image former Pa includes a photosensitive drum 1*a*, a charger 2*a*, a laser exposure device 3*a*, and a developing device 100*a*. The photosensitive drum 1*a* is a photosensitive member having a photosensitive layer on a surface of a metal roller. The photosensitive drum 1*a* is rotated in a direction indicated by an arrow A. The charger 2*a* includes a charging roller configured to charge the photosensitive layer of the photosensitive drum 1*a*. The charger 2*a* may include a charging wire arranged in a non-contact manner with the photosensitive drum 1*a*. The laser exposure device 3*a* includes a light source configured to expose the photosensitive layer of the photosensitive drum 1*a*, which has been charged by the charger 2*a*, to light based on image data on the color component of yellow. An electrostatic latent image having the color component of yellow is thus formed on a surface of the photosensitive drum 1*a*. The developing device 100*a* stores the developer (toner). The developing device 100*a* includes a developing sleeve configured to use the toner to develop the electrostatic latent image formed on the surface of the photosensitive drum 1*a*. The image former Pa uses the charger 2*a*, the laser exposure device 3*a*, and the developing device 100*a* to form a toner image on the photosensitive drum 1*a*. The developing device 100*a* also includes a toner density sensor 80*a* configured to detect an amount of the developer (toner) in the developing device 100*a*. When the toner density sensor 80*a* detects that an amount of the toner in the developing device 100*a* has decreased below a predetermined amount, the developing device 100*a* is replenished with the toner of yellow from the toner bottle Ta containing the toner of yellow. Each of the image formers Pa, Pb, Pc, and Pd is not limited to the configuration including a photosensitive drum. For example, each of the image formers Pa, Pb, Pc, and Pd may include a photosensitive belt. The photosensitive belt is a belt-like photosensitive member having a photosensitive layer.

The image former Pa includes a primary transfer roller 4*a*. The primary transfer roller 4*a* transfers the toner image, which has been formed on the photosensitive drum 1*a*, onto the intermediate transfer belt 7. During the transfer, the primary transfer roller 4*a* brings the photosensitive drum 1*a* and the intermediate transfer belt 7 into contact with each other to form a primary transfer nip portion T1*a*. While the toner image formed on the photosensitive drum 1*a* is passing through the primary transfer nip portion T1*a*, a primary transfer voltage is applied to the primary transfer roller 4*a*. The toner image on the photosensitive drum 1*a* is thus transferred onto the intermediate transfer belt 7. The image former Pa includes a drum cleaner 6*a*. The drum cleaner 6*a* removes the toner remaining on the photosensitive drum 1*a*.

The intermediate transfer belt 7 is an intermediate transfer member. The intermediate transfer belt 7 is stretched around a secondary transfer opposing roller 8, a driven roller 17, a first tension roller 18, and a second tension roller 19. The intermediate transfer belt 7 is rotated in a direction indicated by an arrow B by rotational drive of the secondary transfer opposing roller 8. The toner images of the respective colors, which have been formed by the image formers Pb to Pd in the same manner as in the case of the image former Pa, are sequentially transferred onto the intermediate transfer belt 7 in accordance with rotation of the intermediate transfer belt 7. A toner image in full color is thus formed on the intermediate transfer belt 7. The intermediate transfer belt 7 is rotated so as to convey the transferred toner image in the direction indicated by the arrow B. The image forming apparatus may include an intermediate transfer drum in place of the intermediate transfer belt 7. The intermediate transfer drum or the intermediate transfer belt 7 is an example of an intermediate transfer member.

A secondary transfer roller 9 is arranged at a position opposed to the secondary transfer opposing roller 8 across the intermediate transfer belt 7. The secondary transfer opposing roller 8 and the secondary transfer roller 9 form a secondary transfer nip portion T2. The intermediate transfer belt 7 and a recording material S are sandwiched thereby at the secondary transfer nip portion T2. A secondary transfer voltage is applied to the secondary transfer opposing roller 8, to thereby cause the toner image on the intermediate transfer belt 7 to be transferred onto the recording material S at the secondary transfer nip portion T2. A belt cleaner 11 removes the toner remaining on the intermediate transfer belt 7.

The recording material S is stored in a cassette 60. The recording material S is fed from the cassette 60 by a roller (not shown). The fed recording material S is conveyed to conveyance rollers 61. The conveyance rollers 61 convey the recording material S fed from the cassette 60 to registration rollers 62. The registration rollers 62 perform, for example, skew feed correction for the recording material S. The registration rollers 62 convey the recording material S to the secondary transfer nip portion T2 in accordance with a timing at which the toner image on the intermediate transfer belt 7 is conveyed to the secondary transfer nip portion T2.

The recording material S onto which the toner image has been transferred at the secondary transfer nip portion T2 is conveyed to a fixing device 13. The fixing device 13 includes a fixing roller including a heater and a pressure roller. The fixing device 13 fixes the toner image to the recording material S by heat generated by the heater and pressure applied between the fixing roller and the pressure roller. The recording material S to which the toner image has been fixed is delivered from the image forming apparatus 200 by rollers 64. As described above, the printed matter in which the image is formed on the recording material S is generated.

The image forming apparatus 200 performs the image forming operation to be described below based on the image data acquired from, for example, a personal computer (not shown) or a scanner (not shown). The image forming operation is described below. The image forming operation is controlled by a controller 700 built into the image forming apparatus 200.

When the image forming operation is started, the photosensitive drums 1*a*, 1*b*, 1*c*, and 1*d* start to be rotated in the direction indicated by the arrow A. The chargers 2*a*, 2*b*, 2*c*, and 2*d* uniformly charge the surfaces of the photosensitive drums 1*a*, 1*b*, 1*c*, and 1*d*. The laser exposure devices 3*a*, 3*b*, 3*c*, and 3*d* expose the photosensitive drums 1*a*, 1*b*, 1*c*, and 1*d* based on the image data. In this manner, the electrostatic latent images of the respective color components corresponding to the image data are formed on the photosensitive drums 1*a*, 1*b*, 1*c*, and 1*d*.

The developing devices 100*a*, 100*b*, 100*c*, and 100*d* develop the electrostatic latent images on the photosensitive drums 1*a*, 1*b*, 1*c*, and 1*d*, to thereby form the toner images of the respective color components on the photosensitive drums 1*a*, 1*b*, 1*c*, and 1*d*. The toner images on the photosensitive drums 1*a*, 1*b*, 1*c*, and 1*d* are conveyed to the primary transfer nip portions T1*a*, T1*b*, T1*c*, and T1*d* in accordance with the rotation of the photosensitive drums 1*a*, 1*b*, 1*c*, and 1*d*. At the primary transfer nip portions T1*a*, T1*b*, T1*c*, and T1*d*, the toner images of the respective color components on the photosensitive drums 1*a*, 1*b*, 1*c*, and 1*d* are transferred onto the intermediate transfer belt 7 by the primary transfer rollers 4*a*, 4*b*, 4*c*, and 4*d*. The toner image in full color is thus formed on the intermediate transfer belt 7. The toners remaining on the photosensitive drums 1*a*, 1*b*, 1*c*, and 1*d* are removed by the drum cleaners 6*a*, 6*b*, 6*c*, and 6*d*.

The recording material S is fed from the cassette 60 in accordance with the timing at which the toner images start to be formed on the photosensitive drums 1*a*, 1*b*, 1*c*, and 1*d*. The fed recording material S is conveyed toward the registration rollers 62 by the conveyance rollers 61. The registration rollers 62 adjust the timing to convey the recording material S to the secondary transfer nip portion T2 so that the toner image on the intermediate transfer belt 7 is to be transferred onto the recording material S at a predetermined position. The secondary transfer roller 9 causes the toner image on the intermediate transfer belt 7 to be transferred onto the recording material S at the secondary transfer nip portion T2. The toner remaining on the intermediate transfer belt 7 without being transferred onto the recording material S at the secondary transfer nip portion T2 is removed by the belt cleaner 11.

The recording material S bearing the toner image is conveyed to the fixing device 13. The fixing device 13 fixes an unfixed toner image to the recording material S through melting. The recording material S that has passed through the fixing device 13 is delivered from the image forming apparatus 200 by the rollers 64. The image forming apparatus 200 generates the printed matter by forming the image based on the image data on the recording material S by such an image forming operation.

Controller

Figure 2:
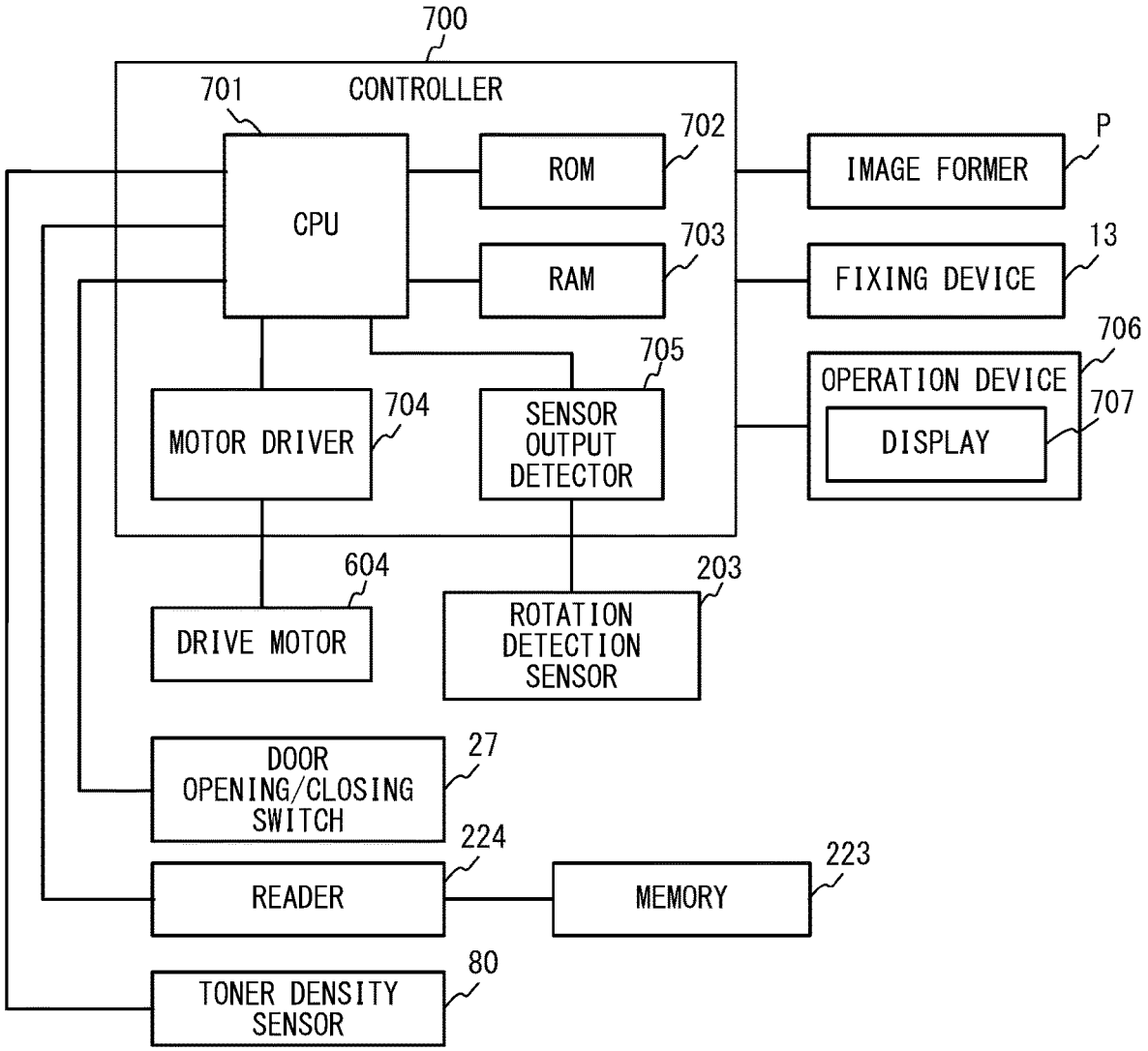
FIG. 2 is a configuration diagram of a controller.

FIG. 2 is a configuration diagram of the controller 700. In the following description, the symbols "a", "b", "c", and "d" for distinguishing colors are omitted when the description does not require distinction of colors. For example, the toner bottles Ta, Tb, Tc, and Td are referred to as "toner bottle T". The developing devices 100*a*, 100*b*, 100*c*, 100*d* are referred to as "developing device 100". The image formers Pa, Pb, Pc, and Pd are referred to as "image former P". The toner density sensors 80*a*, 80*b*, 80*c*, and 80*d* are referred to as "toner density sensor 80".

The controller 700 is connected to the image former P, the fixing device 13, and the toner density sensor 80, which are described above. In addition, the controller 700 is connected to an operating device 706, a drive motor 604, a rotation detection sensor 203, a door opening/closing switch 27, and a reader 224.

The controller 700 is a computer system including a central processing unit (CPU) 701, a read-only memory (ROM) 702, and a random-access memory (RAM) 703. The CPU 701 uses the RAM 703 as a work area to execute a control program for controlling different kinds of processing, which is stored in the ROM 702, to thereby control an operation of each component of the image forming apparatus 200. The controller 700 includes a motor driver 704 and a sensor output detector 705. The CPU 701 causes the motor driver 704 to control the drive motor 604. The CPU 701 causes the sensor output detector 705 to acquire a detection result from the rotation detection sensor 203.

The toner density sensor 80 outputs a signal indicating magnetic permeability that changes based on, for example, an amount of the toner in the developing device 100. The toner density sensor 80 may be configured as any sensor that can detect the amount of the toner in the developing device 100. The CPU 701 converts an output signal from the toner density sensor 80 into a toner density based on a conversion table (not shown). The CPU 701 performs control for replenishing the developing device 100 with toner from the toner bottle T so that the toner density reaches a target density.

The operating device 706 is a user interface including an input device and an output device. Examples of the input device include different kinds of key buttons and a touch panel. Examples of the output device include a display 707 being a touch panel. The operating device 706 transmits to the CPU 701 an instruction input by a user through use of the key buttons and the touch panel. The operating device 706 displays screens including a warning screen and an unmounted state alert screen, which are described later, on the display 707 based on signals from the CPU 701. The operating device 706 notifies the user of a state of the image forming apparatus 200 based on a signal from the CPU 701. The output device may be, for example, a monitor externally connected to the image forming apparatus 200 through a network so as to enable communication therebetween.

The drive motor 604 is a drive source configured to rotate the toner bottle T in order to replenish the developing device 100 with toner from the toner bottle T. The motor driver 704 controls the drive motor 604. To control the drive motor 604, the motor driver 704 controls an electric current to be supplied to the drive motor 604. The drive motor 604 is controlled by pulse width modulation (PWM). The CPU 701 uses a PWM signal to set a control value indicating a time period for supplying the electric current per unit time. The CPU 701 inputs the PWM signal to the motor driver 704. The motor driver 704 controls an amount of the electric current to be supplied to the drive motor 604 based on the PWM signal. In this embodiment, a direct current (DC) motor (DC brush motor) is used as the drive motor 604. Therefore, a rotation speed and a rotational drive force of the drive motor 604 are determined based on a time ratio of the electric current to be supplied to the drive motor 604 per predetermined time period.

The motor driver 704 can supply the electric current to the drive motor 604 while acquiring an enable signal (ENB signal) from the CPU 701. That is, while acquiring the ENB signal from the CPU 701, the motor driver 704 supplies an electric current corresponding to the PWM signal to the drive motor 604 to drive the drive motor 604. The motor driver 704 drives the drive motor 604, to thereby rotationally drive the toner bottle T. When the CPU 701 stops the ENB signal, the motor driver 704 stops supplying the electric current to the drive motor 604. This causes the drive motor 604 to stop operating, to thereby stop rotation of the toner bottle T.

The rotation detection sensor 203 is an optical sensor including a light emitter and a light receiver. The rotation detection sensor 203 outputs a signal corresponding to an amount of light emitted from the light emitter and received by the light receiver. While a predetermined region of the toner bottle T is passing through a detection position of the rotation detection sensor 203, the amount of the light received by the light receiver is equal to or larger than a threshold value. While a region other than the predetermined region of the toner bottle T is passing through the detection position of the rotation detection sensor 203, the amount of the light received by the light receiver decreases below the threshold value. In this manner, when the predetermined region of the toner bottle T passes through the detection position of the rotation detection sensor 203, the rotation detection sensor 203 detects the rotation of the toner bottle T. A specific configuration of the rotation detection sensor 203 is described later.

The sensor output detector 705 acquires an output signal that is a detection result from the rotation detection sensor 203. The sensor output detector 705 outputs a low-level signal when the output signal exhibited with the amount of the received light being equal to or larger than the threshold value is acquired from the rotation detection sensor 203. The sensor output detector 705 outputs a high-level signal when the output signal exhibited with the amount of the received light being smaller than the threshold value is acquired from the rotation detection sensor 203. That is, the sensor output detector 705 outputs the low-level signal while the predetermined region of the toner bottle T is passing through the detection position of the rotation detection sensor 203, and outputs the high-level signal while the region other than the predetermined region of the toner bottle T is passing through the detection position.

The reader 224 manages replenishment information on the toner bottle T mounted in the image forming apparatus 200. As described later in detail, a memory 223 configured to store the replenishment information is mounted to the toner bottle T. The reader 224 communicates the memory 223 to read the replenishment information and transmit the replenishment information to the CPU 701. The reader 224 can also write the replenishment information acquired from the CPU 701 to the memory 223. That is, the reader 224 functions as a reader/writer for the memory 223. The replenishment information includes, for example, a color of toner contained in the toner bottle T, identification information on the toner bottle T, a serial number of the toner bottle T, a replenishment history of the toner bottle T, and other such information relating to the toner bottle T. The replenishment history of the toner bottle T includes, for example, information on the number of rotations of the toner bottle T. The CPU 701 causes the reader 224 to update the information on the number of rotations of the toner bottle T each time one rotation of the toner bottle T is detected based on the signal output from the sensor output detector 705. The toner bottle T stores the accumulated information on the number of rotations. An amount of the toner to be supplied to the developing device 100 per rotation is determined for the toner bottle T. Therefore, the number of rotations of the toner bottle T corresponds to the number of times that the developing device 100 is replenished with the toner from the toner bottle T, and indicates a replenishment amount of the toner.

The motor driver 704, the sensor output detector 705, the rotation detection sensor 203, and the reader 224 are provided for each color. The drive motor 604 may be provided for each color, but may be configured so that, for example, a plurality of toner bottles T are rotated by a single drive motor. One drive motor 604 can selectively rotate the plurality of toner bottles T through use of a clutch configured to control a state in which a drive force can be transmitted from the drive motor 604 to the toner bottle T and a state in which the drive force cannot be transmitted from the drive motor 604 to the toner bottle T.

Figure 3:
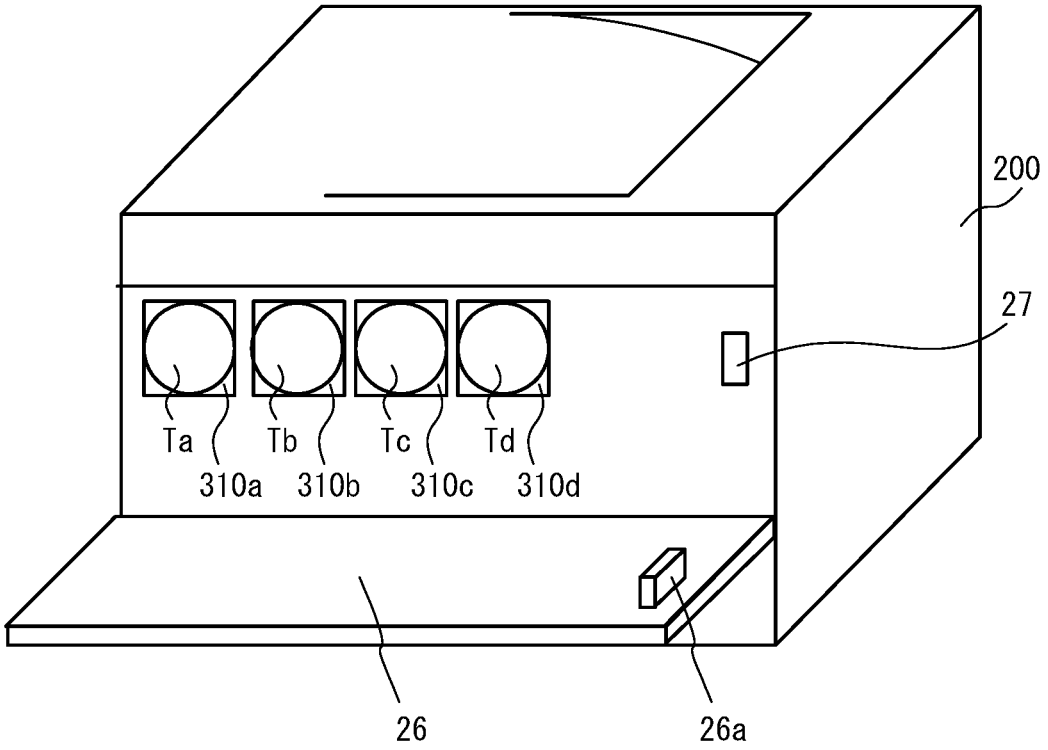
FIG. 3 is an external view of the image forming apparatus.

The door opening/closing switch 27 transmits an opening/closing detection signal to the CPU 701 in accordance with the opening or closing of a door 26 provided to a casing of the image forming apparatus 200. The opening/closing detection signal is, for example, a binary signal. The CPU 701 detects an open state or a closed state of the door based on the opening/closing detection signal. For example, when the opening/closing detection signal is at a low level, the CPU 701 determines that the door is in the closed state. When the opening/closing detection signal is at a high level, the CPU 701 determines that the door is in the open state. With reference to FIG. 3, the opening or closing of the door is described.

FIG. 3 is an external view of the image forming apparatus 200. In FIG. 3, in the image forming apparatus 200, a door 26, opening or closing of which is to be detected by the door opening/closing switch 27, is in an open state. When the door 26 is in an open state, mounting units 310*a*, 310*b*, 310*c*, and 310*d* to which the toner bottles Ta, Tb, Tc, and Td, respectively, are to be mounted are exposed. In the following description, the toner bottles Ta, Tb, Tc, and Td are referred to as "toner bottle T", and the mounting units 310*a*, 310*b*, 310*c*, and 310*d* are referred to as "mounting unit 310". The door 26 is opened and closed by the user when the toner bottle T is mounted or removed. The door 26 includes a protruding portion 26*a*. When the door 26 is closed, the protruding portion 26*a* presses the door opening/closing switch 27. When the door 26 is closed to cause the protruding portion 26*a* to press the door opening/closing switch 27, the door opening/closing switch 27 outputs a low-level opening/closing detection signal. When the door 26 is opened to cancel the pressing of the protruding portion 26*a*, the door opening/closing switch 27 outputs a high-level opening/closing detection signal. The door 26 may be configured to open or close only the mounting unit 310. In another case, the door 26 may be configured to open or close the entirety of one side surface of the image forming apparatus 200.

Mounting Unit

Figure 4A:
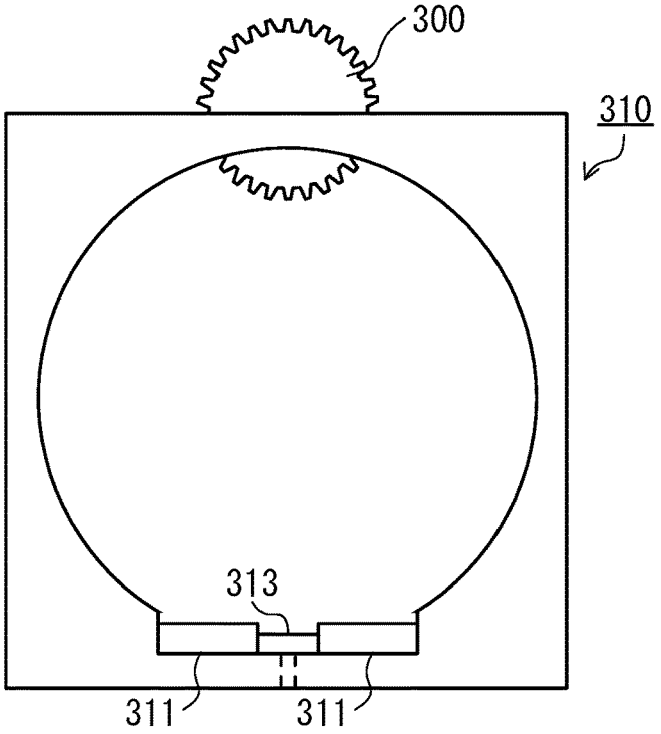
FIG. 4A and FIG. 4B are explanatory diagrams of a configuration of a mounting unit.
Figure 4B:
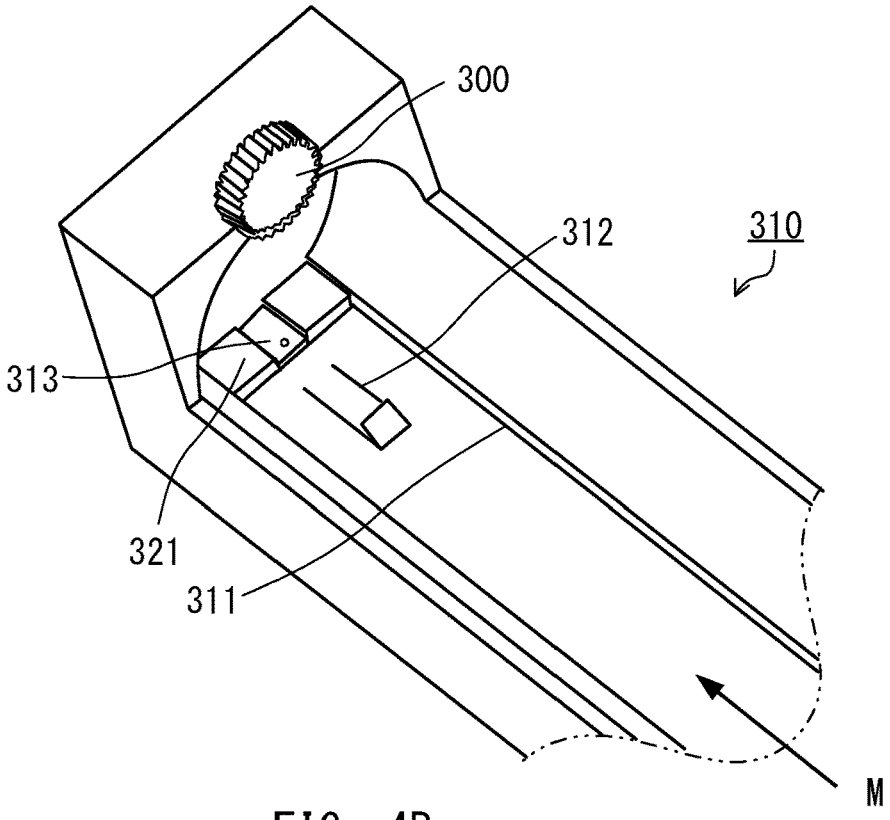

FIG. 4A and FIG. 4B are explanatory diagrams of a configuration of a mounting unit 310. FIG. 4A is a partial front view of the mounting unit 310 as viewed from the front in a direction of mounting the toner bottle T. FIG. 4B is a perspective view for illustrating the inside of the mounting unit 310. As illustrated in FIG. 4B, the toner bottle T is inserted into the mounting unit 310 in a direction indicated by an arrow M. The direction indicated by the arrow M is the same as a direction of a rotation axis of each of the photosensitive drums 1*a*, 1*b*, 1*c*, and 1*d* of the image forming apparatus 200. When being removed from the mounting unit 310, the toner bottle T is pulled out in a direction reverse to the direction indicated by the arrow M.

The mounting unit 310 includes a driving gear 300, a rotation regulation portion 311, a bottom portion 321, and a regulating portion 312. The driving gear 300 transmits a rotational drive force from the drive motor 604 to the toner bottle T mounted to the mounting unit 310. The toner bottle T discharges toner by being rotated. The rotation regulation portion 311 regulates a cap portion of the toner bottle T, which is described later, so as not to be rotated in accordance with rotation of the toner bottle T. The regulation portion 312 is engaged with the cap portion of the toner bottle T, to thereby regulate the movement along a direction of a rotation axis of the cap portion.

The bottom portion 321 has an inlet 313 formed therein. The inlet 313 communicates to a toner outlet of the mounted toner bottle T, and is configured to receive the toner discharged from the toner bottle T. The toner discharged from the outlet of the toner bottle T passes through the inlet 313 to be supplied to the developing device 100. In this embodiment, the diameter of the inlet 313 is the same as the diameter of the outlet of the toner bottle T, and is, for example, about 2 mm.

Toner Bottle

Figure 5A:
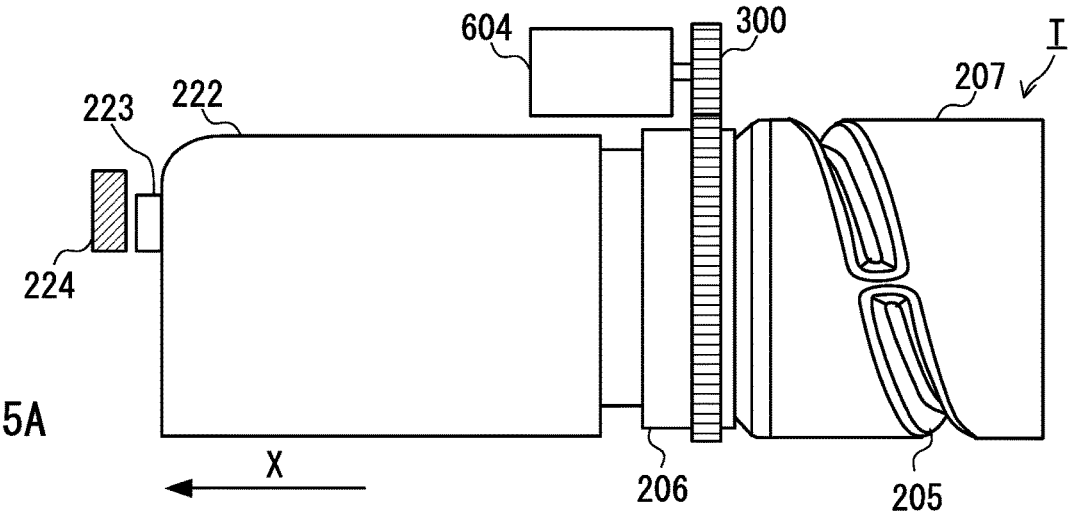
FIG. 5A, FIG. 5B, and FIG. 5C are explanatory diagrams of a toner bottle.
Figure 5B:
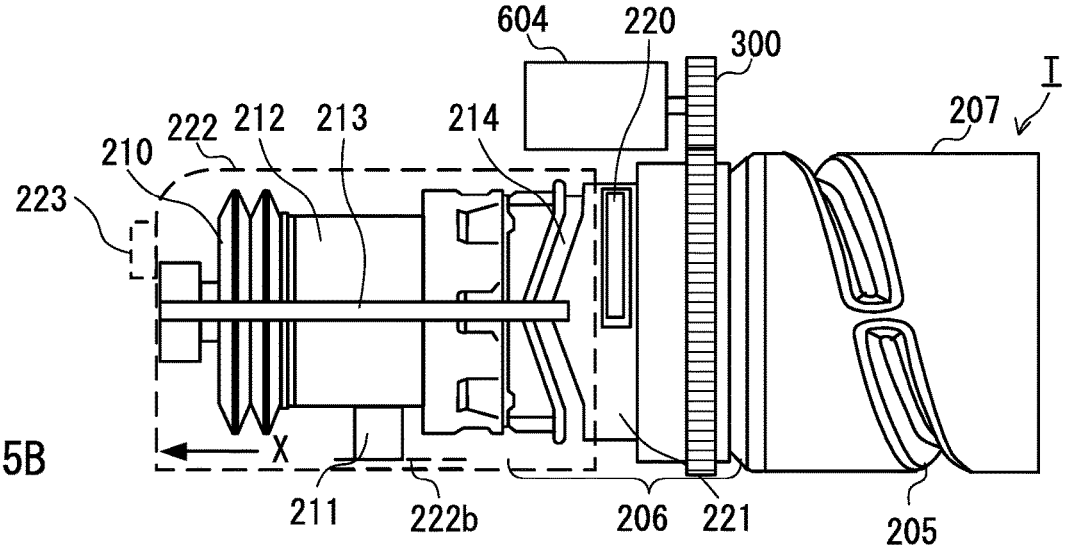
Figure 5C:
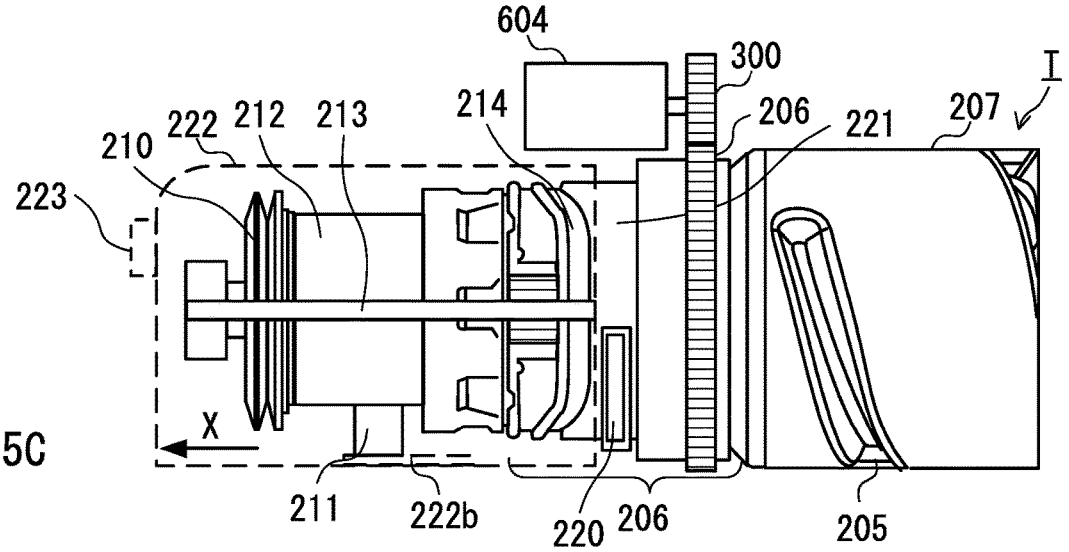

FIG. 5A to FIG. 5C are explanatory diagrams of the toner bottle T. FIG. 5A is an external view of the toner bottle T mounted to the mounting unit 310. FIG. 5B and FIG. 5C are explanatory diagrams of an internal structure of the toner bottle T mounted to the mounting unit 310. The toner bottle T includes a storage portion 207 configured to contain toner, a drive transmission portion 206, to which a rotational drive force is to be transmitted from the drive motor 604 via the driving gear 300, and a cap portion 222 including a configuration for discharging the toner. The cap portion 222 includes, in its inside, a discharge portion 212 including an outlet 211 for discharging the toner, a pump portion 210 for discharging the toner inside the discharge portion 212 from the outlet 211, and a reciprocating member 213 configured to expand and contract the pump portion 210.

The drive transmission portion 206 includes a protruding portion 220, a detected portion 221, and a cam groove 214. The cam groove 214 is formed around the drive transmission portion 206 by one round in a rotation direction of the drive transmission portion 206. The cam groove 214, the detected portion 221, and the protruding portion 220 are integrally formed to be integrally rotated as the drive transmission portion 206. The drive transmission portion 206 and the storage portion 207 coupled to the drive transmission portion 206 are rotated by the rotational drive force, which is transmitted from the drive motor 604 to the drive transmission portion 206 of the toner bottle T via the driving gear 300.

In the storage portion 207, a recessed portion 205 recessing into the inside is formed. The recessed portion 205 is helically formed along an outer periphery of the storage portion 207. The recessed portion 205 causes the toner inside the storage portion 207 to be conveyed to the discharge portion 212 side in accordance with rotation of the storage portion 207.

The cap portion 222 has the rotation regulated by the mounting unit 310 as described above, and is not rotated even when the drive transmission portion 206 is rotated at the time of mounting. The outlet 211, the pump portion 210, and the reciprocating member 213 are also regulated so as not to be rotated in the same manner as the cap portion 222. Therefore, even when the drive transmission portion 206 is rotated, the outlet 211, the pump portion 210, and the reciprocating member 213 are not rotated.

A rotation regulation groove is formed inside the cap portion 222. The rotation regulation groove regulates the reciprocating member 213 so as not to be rotated when the drive transmission portion 206 is rotated. To that end, the reciprocating member 213 is engaged with the rotation regulation groove. The reciprocating member 213 is connected to the pump portion 210, and a claw portion (not shown) is engaged with the cam groove 214 of the drive transmission portion 206. The rotation of the drive transmission portion 206 causes the reciprocating member 213 to move along the cam groove 214 while being regulated so as not to be rotated. With this configuration, the reciprocating member 213 reciprocates in a direction indicated by an arrow X (longitudinal direction of the toner bottle T).

The reciprocating member 213 is coupled to the pump portion 210. With reciprocation of the reciprocating member 213, the pump portion 210 repeats expansion and contraction. That is, the reciprocating member 213 is moved in the direction indicated by the arrow X, to thereby expand the pump portion 210. The expansion of the pump portion 210 lowers an inner pressure in the toner bottle T, causes air to be taken in from the outlet 211, and loosens the toner in the discharge portion 212. The movement of the reciprocating member 213 in a direction reverse to the direction indicated by the arrow X causes the pump portion 210 to be contracted. The contraction of the pump portion 210 increases the inner pressure in the toner bottle T, and the toner deposited at the outlet 211 is supplied from the outlet 211 to the developing device 100. In short, the drive motor 604 functions as a drive source configured to rotate the toner bottle T mounted to the mounting unit 310, to thereby expand and contract the pump portion 210.

The memory 223 configured to store the information (replenishment information) relating to the toner bottle T, which is described above, is attached to the cap portion 222. The CPU 701 causes the reader 224 to communicate to/from the memory 223 to read the replenishment information on the toner bottle T from the memory 223. The replenishment information includes the identification information on the toner bottle T. For example, the CPU 701 performs identification processing on the toner bottle T based on the identification information stored in the memory 223. The replenishment information further includes the value of the number of rotations of the toner bottle T. Each time the toner bottle T is rotated by a predetermined number of rotations, for example, ½ rotation, the CPU 701 causes the reader 224 to update the information on the number of rotations of the toner bottle T, which is stored in the memory 223.

The cap portion 222 includes a sealing member **222*b* configured to seal the outlet 211. It is possible to prevent the toner in the toner bottle T from leaking out of the outlet 211 by sealing the outlet 211 with the sealing member 222*b*. The sealing member 222*b* is removed when the toner bottle T is mounted to the mounting unit 310. The removal of the sealing member 222*b* releases the outlet 211** of the toner bottle T.

FIG. 5B is an illustration of a state in which the pump portion 210 of the toner bottle T is expanded to a maximum. FIG. 5C is an illustration of a state in which the pump portion 210 of the toner bottle T is contracted to a maximum. The pump portion 210 is a bellows-like pump made of a resin, which is variable in capacity in accordance with expansion and contraction motion. That is, the pump portion 210 is formed of "mountain-fold" portions and "valley-fold"

portions arranged alternately and repeatedly along the longitudinal direction of the toner bottle T.

In this embodiment, a replenishment operation for the toner is performed two times while the toner bottle T is rotated by one round. One round of the replenishment operation starts with a state in which the pump portion 210 is contracted to a maximum, followed by expansion and contraction, and ends with a state in which the pump portion 210 is contracted to a maximum again. To that end, the cam groove 214 is formed to have two peak portions and two valley regions in order of "valley→peak→valley→peak". While a position of the cam groove 214 engaged with the reciprocating member 213 is changed from the valley to the peak, the pump portion 210 is being expanded to a maximum. While the position of the cam groove 214 engaged with the reciprocating member 213 is changed from the peak to the valley, the pump portion 210 is being contracted to a maximum. When the position of the cam groove 214 engaged with the reciprocating member 213 is at the valley, the pump portion 210 maintains the state of being contracted to a maximum.

Rotation Detection Sensor

Figure 6A:
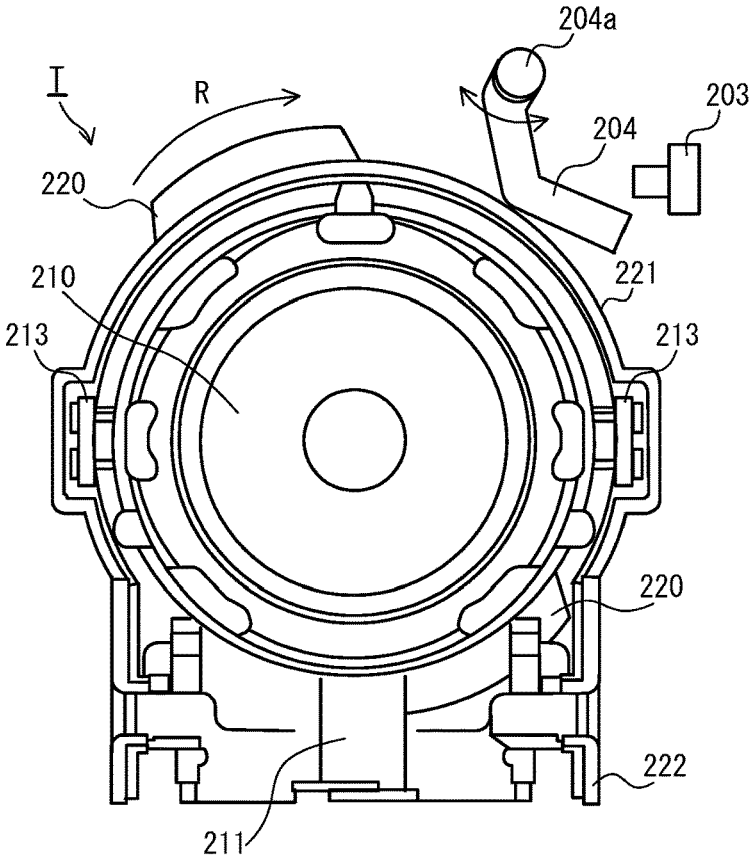
FIG. 6A and FIG. 6B are explanatory diagrams of a rotation detection sensor.
Figure 6B:
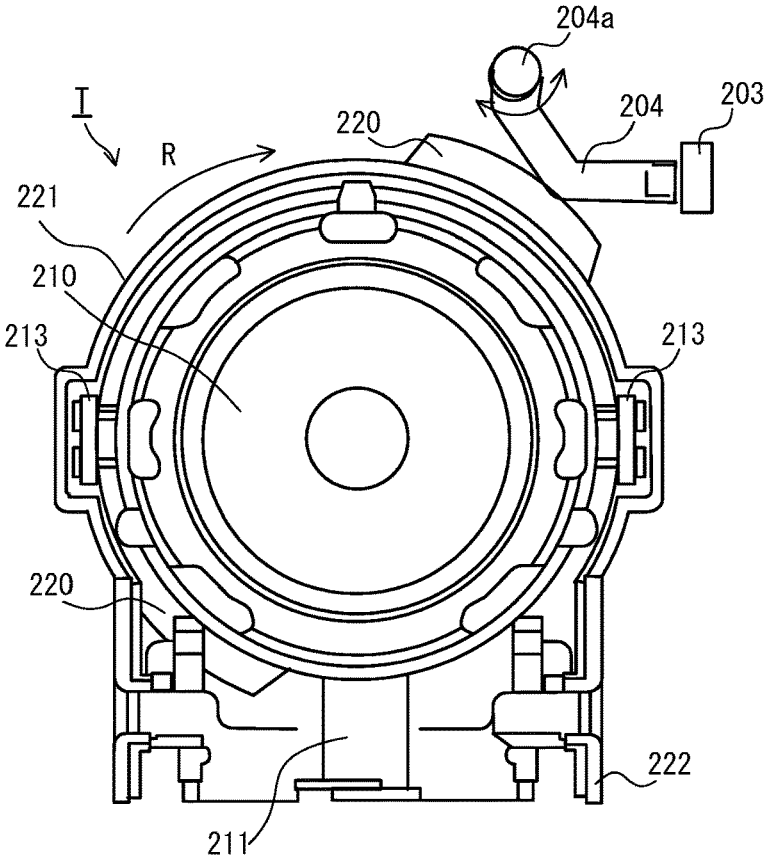

FIG. 6A and FIG. 6B are explanatory diagrams of the rotation detection sensor 203. As described above, the rotation detection sensor 203 is the optical sensor including the light emitter and the light receiver configured to receive light emitted from the light emitter. The rotation detection sensor 203 detects the rotation of the toner bottle T based on a change in light receiving state of the light receiver due to a flag 204. The flag 204 is a bending member configured to swing about a rotary shaft 204*a*.

The flag 204 has a bent part brought into contact with the detected portion 221 of the toner bottle T due to its self-weight. With the bent part of the flag 204 being in contact with the detected portion 221, a free end being a tip portion of the flag 204 is not brought into contact with the rotation detection sensor 203. Under this state, light from the light emitter of the rotation detection sensor 203 is received by the light receiver without being blocked. When brought into contact with the protruding portion 220 of the drive transmission portion 206, the flag 204 is lifted up to have the free end brought into contact with the rotation detection sensor 203. Under this state, the light from the light emitter of the rotation detection sensor 203 is blocked to fail to be received by the light receiver.

In this manner, the rotation detection sensor 203 can determine whether or not the flag 204 is in contact with the protruding portion 220. The rotation detection sensor 203 detects the contact between the flag 204 and the protruding portion 220, to thereby be able to detect a rotation phase (rotation angle) of the toner bottle T. That is, the rotation detection sensor 203 can detect a rotation phase at which the protruding portion 220 of the toner bottle T is brought into contact with the flag 204. The rotation detection sensor 203 can detect the rotation of the toner bottle T with the protruding portion 220 of the toner bottle T being set as a predetermined portion.

FIG. 6A is an illustration of a state in which the flag 204 is brought into abutment with the detected portion 221. The detected portion 221 overlaps with a region in which the protruding portion 220 of the drive transmission portion 206 is formed, and is a region different from the protruding portion 220 in the rotation direction of the drive transmission portion 206. In this case, the flag 204 does not block the light from the light emitter of the rotation detection sensor 203. Therefore, the light receiver receives the light emitted from the light emitter. The amount of light received by the light receiver thus becomes equal to or larger than the threshold value. The sensor output detector 705 outputs a low-level (L) signal due to the fact that the amount of light received by the light receiver is equal to or larger than the threshold value. In short, the sensor output detector 705 transmits a low-level signal to the CPU 701 while the flag 204 is in contact with the detected portion 221.

FIG. 6B is an illustration of a state in which the flag 204 is brought into abutment with the protruding portion 220. In this case, the flag 204 blocks the light from the light emitter of the rotation detection sensor 203. Therefore, the light receiver does not receive the light emitted from the light emitter. The amount of light received by the light receiver thus becomes smaller than the threshold value. The sensor output detector 705 outputs a high-level (H) signal due to the fact that the amount of light received by the light receiver is smaller than the threshold value. In short, the sensor output detector 705 transmits a high-level signal to the CPU 701 while the flag 204 is in contact with the protruding portion 220.

The CPU 701 detects a position of the protruding portion 220 based on a level of the signal acquired from the sensor output detector 705. This enables the CPU 701 to detect a rotation phase of the toner bottle T. After the signal output from the sensor output detector 705 is changed from a high level to a low level, the pump portion 210 of the toner bottle T starts to be expanded. While the signal output from the sensor output detector 705 maintains a low level, the pump portion 210 is being expanded to a maximum and then starts to be contracted. Before the signal output from the sensor output detector 705 is changed from a low level to a high level, the pump portion 210 shifts to the state of being contracted to a maximum. In short, while the flag 204 is in abutment with the detected portion 221, the pump portion 210 is being contracted to supply the toner to the developing device 100.

Rotation Speed Control

The drive motor 604 in this embodiment is a DC motor (DC brush motor) as described above. When the drive motor 604 rotationally drives the toner bottle T, a rotation speed of the toner bottle T varies depending on a weight of the toner bottle T. As the developing device 100 is replenished with more toner from the toner bottle T, the amount of the toner contained in the toner bottle T decreases, to thereby become lighter in weight. When the drive motor 604 rotates the toner bottle T based on a fixed PWM value even after the amount of the toner in the toner bottle T has decreased, the rotation speed of the toner bottle T becomes higher than a target rotation speed.

It has been found from experiments that the amount (replenishment amount) of the toner with which the developing device 100 is replenished from the toner bottle T is an amount corresponding to a speed with which the inner pressure in the toner bottle T changes. That is, when a decrease in weight of the toner bottle T causes the rotation speed of the toner bottle T to become higher than the target rotation speed, the replenishment amount of the toner bottle T becomes larger than a target replenishment amount. In addition, even a mere increase in rotation speed of the toner bottle T leads to an increase in replenishment amount of toner discharged from the toner bottle T to be supplied to the developing device 100 at a time. Specifically, a toner replenishment amount exhibited when the rotation speed of the toner bottle T is 120 rpm becomes larger than a toner replenishment amount exhibited when the rotation speed of the toner bottle T is 30 rpm by 40%. In a configuration in which the developing device 100 is replenished with toner directly from the toner bottle T, there is a fear that there may be a change in density of printed matter when the toner replenishment amount has changed by 40%.

In this embodiment, one round of a toner replenishment operation starts with a state in which the pump portion 210 is contracted to a maximum, followed by expansion and contraction of the pump portion 210, and ends with a state in which the pump portion 210 is contracted to a maximum. The toner replenishment amount is affected by the rotation speed exhibited when the pump portion 210 is compressed. A position in a rotation starting state (namely, the rotation stopping state of the previous toner replenishment) of the toner bottle T in this embodiment is designed so as to stabilize the drive motor 604 at the target rotation speed before the pump portion 210 starts to be compressed. In addition, in this embodiment, the rotation speed of the toner bottle T is feedback controlled. This reduces a change in rotation speed of the toner bottle T in accordance with a change in weight of the toner bottle T. In order to perform the feedback control with high precision, it is important for the controller 700 to measure the rotation speed of the toner bottle T with high precision.

The drive motor 604 takes much time to reach the target rotation speed after starting the rotation. The drive motor 604 also takes much time to stop the rotation after the ENB signal is stopped. Therefore, the controller 700 is required to measure the rotation speed after detecting a timing at which the drive motor 604 is stabilized at the target rotation speed. As described above, the drive motor 604 in this embodiment is designed so as to be stabilized at the target rotation speed before the pump portion 210 starts to be compressed. Therefore, the controller 700 measures the rotation speed of the toner bottle T at the timing at which the pump portion 210 is compressed.

Figure 7:
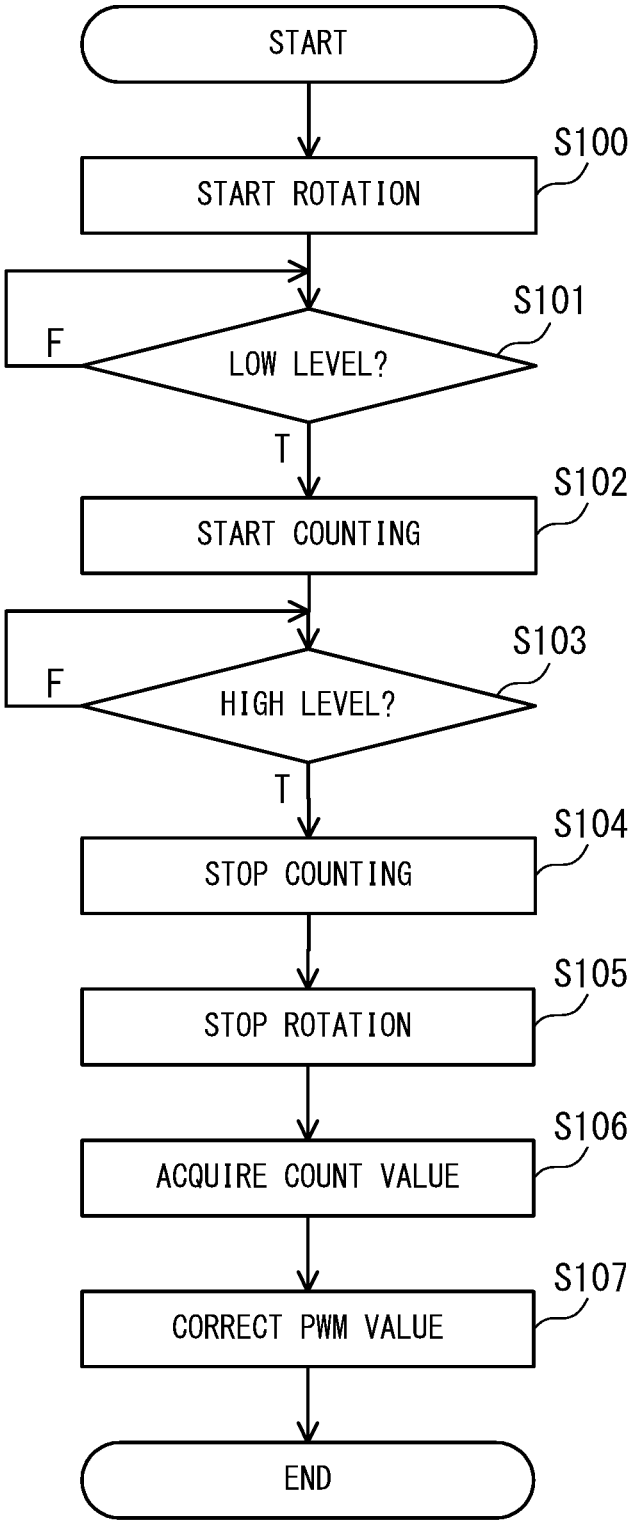
FIG. 7 is a flow chart for illustrating control processing for a rotation speed.

FIG. 7 is a flow chart for illustrating control processing for the rotation speed of the drive motor 604. In this processing, the drive motor 604 is controlled so as to rotate at the target rotation speed. This processing is executed when the developing device 100 is replenished with toner from the toner bottle T. The controller 700 executes this processing based on a toner replenishment instruction. The toner replenishment instruction is generated when, for example, the amount of the toner in the developing device 100, which is detected by the toner density sensor 80, has decreased below a predetermined amount.

The CPU 701, which has acquired the toner replenishment instruction, controls the drive motor 604 to start to rotate the toner bottle T (Step S100). The CPU 701 sets the PWM value, which is stored in the RAM 703, in the motor driver 704 as the control value, and transmits the ENB signal to the motor driver 704. The motor driver 704, which has acquired the ENB signal, supplies an electric current corresponding to the PWM value to drive the drive motor 604. With this drive, the drive motor 604 starts to rotate the toner bottle T. When the PWM value is not stored in the RAM 703, for example, the CPU 701 sets a predetermined initial value as the PWM value.

When the toner bottle T starts to be rotated, the CPU 701 stands by until a low-level signal is acquired from the sensor output detector 705 (F in Step S101). That is, the CPU 701 stands by until the flag 204 is brought into abutment with the detected portion 221. When receiving a low-level signal from the sensor output detector 705 (T in Step S101), the CPU 701 starts counting corresponding to a predetermined clock signal (Step S102). The CPU 701 stands by until a high-level signal is acquired from the sensor output detector 705 (F in Step S103). That is, the CPU 701 stands by until the flag 204 is brought into abutment with the protruding portion 220.

When the signal output from the sensor output detector 705 is changed from a low level to a high level, the CPU 701 acquires a high-level signal (Tin Step S103). The CPU 701, which has acquired a high-level signal, stops the counting (Step S104). The CPU 701 stores a count value Tn, which is a result of the counting, in the RAM 703. With the processing from Step S101 to Step S104, the CPU 701 measures a period (count value Tn) during which a low-level signal has been being output from the sensor output detector 705. The period during which the signal output from the sensor output detector 705 has remained at a low level corresponds to a period during which the flag 204 has remained in abutment with the detected portion 221 in accordance with the rotation of the toner bottle T.

The CPU 701 determines that one round (one block) of a replenishment operation has been performed based on the fact that the output from the sensor output detector 705 has been changed from the low level to the high level. Therefore, the CPU 701 stops the rotation of the toner bottle T (Step S105). The CPU 701 stops transmitting the ENB signal to the motor driver 704. With this stopping, the motor driver 704 stops the rotational drive of the toner bottle T.

The CPU 701 acquires the count value Tn stored in the RAM 703 (Step S106). As described above, the count value Tn corresponds to a time period during which the detected portion 221 has kept being detected by the rotation detection sensor 203 while the toner bottle T has been being rotated. The time period during which the detected portion 221 has kept being detected by the rotation detection sensor 203 corresponds to a time period during which the pump portion 210 has been being expanded and contracted. This corresponds to a time period during which the replenishment operation for replenishing the developing device 100 with toner from the toner bottle T has been performed.

The CPU 701 corrects the PWM value stored in the RAM 703 based on the count value Tn to bring the control processing for the rotation speed to an end (Step S107). The correction of the PWM value is performed in the following manner. That is, the CPU 701 first obtains a rotation speed V(n) of the current replenishment operation from the count value Tn. The count value Tn indicates the time period during which the flag 204 has remained in abutment with the detected portion 221. A circumferential length of the detected portion 221 is known, and hence the CPU 701 can obtain the rotation speed V(n) of the current replenishment operation based on the count value Tn. The CPU 701 uses the rotation speed V(n) to calculate a correction value D(n+1) of the PWM value by the following expression.

$$D(n+1)=D(n)+Ki*(Vtgt-V(n))$$

In the expression, D(n) represents the present PWM value (namely, PWM value set in the processing of Step S100), Ki represents a predetermined constant of proportionality, and Vtgt represents a target rotation speed.

The correction value D(n+1) of the PWM value is used for the subsequent replenishment operation. That is, the CPU 701 measures the time period during which the pump portion 210 has been being expanded and contracted, and feedback controls the rotation speed to be used for subsequently rotationally driving the toner bottle T based on the measurement result.

A timing at which the flag 204 is lifted up by the protruding portion 220 corresponds to an end timing of the compression of the pump portion 210. That is, the controller 700 uses a detection result of a front end portion of the protruding portion 220 in a rotation direction as an index indicating both that a measuring time of the rotation speed has ended and that the replenishment operation has ended. With this configuration, it is possible to simplify the structure of the protruding portion 220 provided to the drive transmission portion 206 as well as to simplify the control of the CPU 701.

In the above-mentioned manner, the CPU 701 corrects the PWM value for controlling the rotation speed of the drive motor 604 based on the time period during which the detected portion 221 of the toner bottle T has been being detected. With this correction, the rotation speed of the toner bottle T is controlled at the target rotation speed. Therefore, the toner replenishment amount of the toner bottle T is stabilized.

Transition of Rotation Speed of Drive Motor

Figure 8:
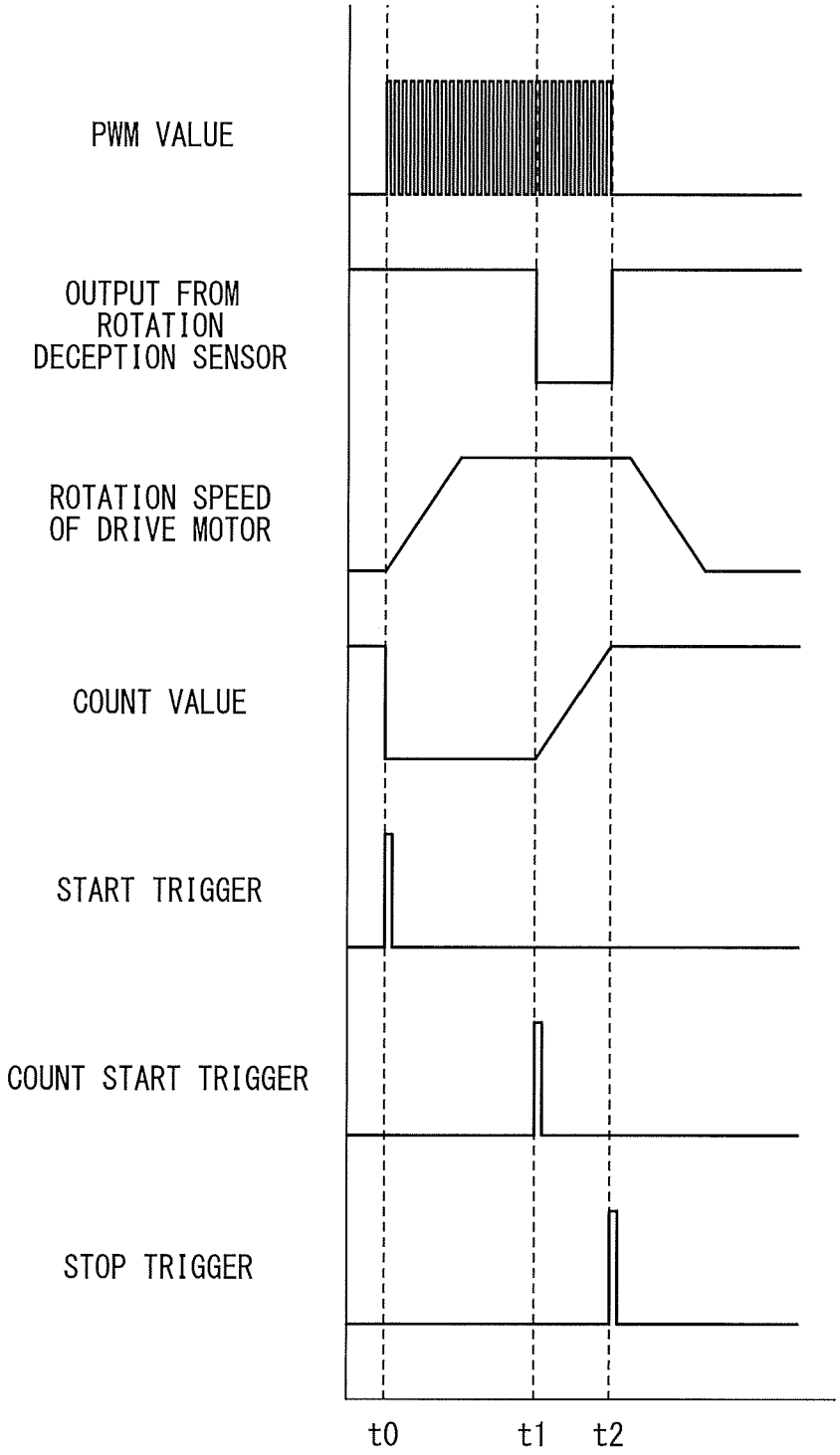
FIG. 8 is a timing chart exhibited at a time of the control processing for the rotation speed.

FIG. 8 is a timing chart exhibited at a time of the control processing for the rotation speed of the drive motor 604. FIG. 8 is the timing chart of the PWM value, the output signal from the sensor output detector 705, the rotation speed of the drive motor 604, the count value Tn, a start trigger for starting the replenishment operation, a count start trigger indicating a count start, and a stop trigger for bringing the replenishment operation to an end.

When replenishing the developing device 100 with toner from the toner bottle T, the CPU 701 outputs a start trigger at a time to. The CPU 701 transmits an ENB signal to the motor driver 704 in accordance with the start trigger. The motor driver 704 starts to control a time period for supplying the electric current based on the PWM value (D(n) % in FIG. 8) to the drive motor 604 in accordance with the ENB signal. In addition, the CPU 701 resets the count value Tn to "0" in accordance with the start trigger. The processing performed at the time t0 corresponds to the processing of Step S100 in FIG. 7.

The rotation speed of the drive motor 604 increases when the rotational drive is started by the motor driver 704. At this time, the sensor output detector 705 outputs a high-level signal. In short, the pump portion 210 of the toner bottle T is in a state of being contracted to a maximum.

At a time t1, the output from the sensor output detector 705 changes from the high level to the low level. The CPU 701 outputs a count start trigger in accordance with the change in output from the sensor output detector 705 from the high level to the low level. With this output, the count value Tn starts to increase. While the sensor output detector 705 outputs a low-level signal, the pump portion 210 is being expanded and contracted. The processing performed at the time t1 corresponds to the processing of Step S101 and Step S102 in FIG. 7.

At a time t2, the output signal from the sensor output detector 705 changes from the low level to the high level. The CPU 701 outputs a stop trigger in accordance with the change in output from the sensor output detector 705 from the low level to the high level. The CPU 701 stops transmitting the ENB signal to the motor driver 704 in accordance with the stop trigger. The CPU 701 stops counting the count value Tn in accordance with the stop trigger. The motor driver 704 stops the rotational drive of the drive motor 604 when the ENB signal is stopped. At this time, the pump portion 210 of the toner bottle T is contracted to a maximum. The CPU 701 causes the motor driver 704 to stop the rotational drive of the drive motor 604. Thus, the rotational drive of the toner bottle T is stopped before the pump portion 210 starts to be expanded. The processing performed at the time t2 corresponds to the processing from Step S103 to Step S105 in FIG. 7.

Detection of Replacement of Toner Bottle

When the toner bottle T is mounted to the mounting unit 310 with a predetermined rotation angle, the flag 204 is brought into a state of being lifted up by the protruding portion 220. That is, when the user mounts the toner bottle T to the mounting unit 310 with the predetermined rotation angle, the signal output by the rotation detection sensor 203 is changed from a low level to a high level. Therefore, the CPU 701 can determine whether or not the toner bottle T has been mounted to the mounting unit 310 of the image forming apparatus 200 with the predetermined rotation angle based on the output from the rotation detection sensor 203.

Figure 9A:
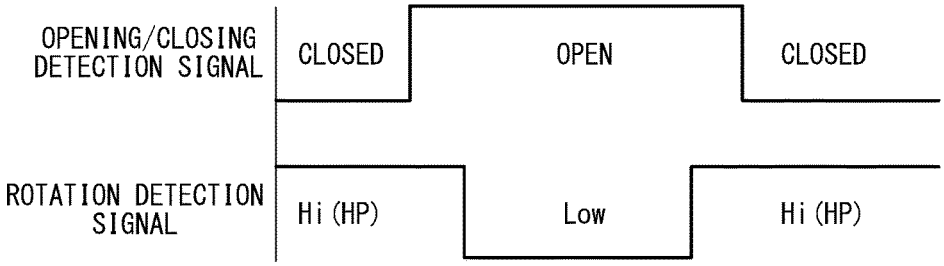
FIG. 9A and FIG. 9B are explanatory diagrams of respective output timings to output signals from a door opening/closing switch and the rotation detection sensor.
Figure 9B:
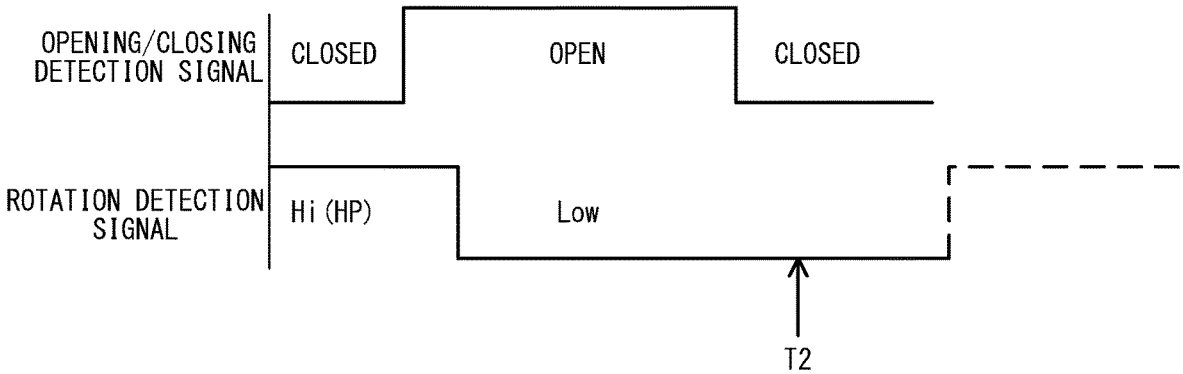

FIG. 9A and FIG. 9B are explanatory diagrams of respective output timings to output a signal from the door opening/closing switch 27 and a signal from the rotation detection sensor 203 when the toner bottle T is replaced. Referring to FIG. 9A and FIG. 9B, a description is given of an operation for determining whether or not the toner bottle T is mounted to the mounting unit 310 of the image forming apparatus 200.

In FIG. 9A and FIG. 9B, when the replenishment operation for the toner is not executed, the toner bottle T is in a stopped state at a home position (HP). At the home position, the flag 204 is lifted up by the protruding portion 220 of the toner bottle T. Therefore, the sensor output detector 705 outputs a rotation detection signal at a high level. When the door 26 is not opened, the opening/closing detection signal being the output signal from the door opening/closing switch 27 is at a low level.

With reference to FIG. 9A, a description is given of a case of replacing the toner bottle T. The user opens the door 26. When the door 26 is brought into an open state, the opening/closing detection signal from the door opening/closing switch 27 is changed to a high level. When the user removes the toner bottle T from the mounting unit 310, the output signal (rotation detection signal) from the sensor output detector 705 is changed from a high level to a low level. This is because, when the toner bottle T is removed, the free end of the flag 204 is retracted from a position between the light emitter and the light receiver due to its self-weight. When the free end of the flag 204 is retracted from the position between the light emitter and the light receiver, the light from the light emitter of the rotation detection sensor 203 is stopped being blocked, and thus the output signal from the sensor output detector 705 is brought to a low level.

After that, when the user mounts a new toner bottle T to the mounting unit 310 with the predetermined rotation angle, the output signal from the sensor output detector 705 is brought to a high level. When the user closes the door 26, the opening/closing detection signal from the door opening/closing switch 27 is brought to a low level.

With such replacement processing for the toner bottle T, while the opening/closing detection signal from the door opening/closing switch 27 is at a high level (while the door 26 is in an open state), the output signal (rotation detection signal) from the sensor output detector 705 is being changed from a high level to a low level. Then, while the opening/closing detection signal from the door opening/closing switch 27 is at a high level (while the door 26 is in an open state), the output signal (rotation detection signal) from the sensor output detector 705 is being changed from a low level to a high level. The CPU 701 can determine that the toner bottle T has been mounted after temporarily being pulled out based on the fact that the output signal (rotation detection signal) from the sensor output detector 705 has been changed in order of "high level→low level→high level" while the opening/closing detection signal from the door opening/closing switch 27 maintains a high level.

However, when the toner bottle T is manually rotated while being kept mounted to the mounting unit 310, the sensor output detector 705 outputs the rotation detection signal at the low level in the same manner as in FIG. 9A. Therefore, the CPU 701 cannot discriminate whether the toner bottle T has been removed from the mounting unit 310 or has been manually rotated.

In this embodiment, while the door opening/closing switch 27 outputs the opening/closing detection signal at the high level, the reader 224 performs communication for reading information from the memory 223 of the toner bottle T, to thereby distinguish between the removal and the rotation of the toner bottle T. Details of a communication timing and removal determination are described later.

It is also possible to determine whether or not the toner bottle T has been removed from the mounting unit 310 based only on a communication state between the reader 224 and the memory 223 of the toner bottle T. However, when the communication has become unable to be normally performed at some midpoint, it is impossible to detect that the toner bottle T has been removed.

In this embodiment, the CPU 701 determines that the toner bottle T has been removed based on a combination of the output signal (rotation detection signal) from the rotation detection sensor 203 and the communication state between the reader 224 and the memory 223. With such determination, the CPU 701 can normally detect that the toner bottle T has been removed, namely, a mounted state of the toner bottle T.

Further, as illustrated in FIG. 9B, the door 26 may be closed when the output signal (rotation detection signal) from the sensor output detector 705 is at a low level. This is a case in which, for example, the door 26 is closed while the toner bottle T has not been mounted to the mounting unit 310 yet. The same applies to the output signal (rotation detection signal) obtained when the toner bottle T is not mounted to the mounting unit 310 correctly (is not mounted with the predetermined rotation angle). Therefore, the CPU 701 cannot determine whether or not the toner bottle T is mounted to the mounting unit 310 when the output signals from the door opening/closing switch 27 and the rotation detection sensor 203 exhibit such waveforms as illustrated in FIG. 9B.

When the door opening/closing switch 27 and the rotation detection sensor 203 output such output signals as illustrated in FIG. 9B, in order to detect presence or absence of the toner bottle T, the image forming apparatus 200 according to this embodiment causes the drive motor 604 to rotate the toner bottle T. When the toner bottle T is mounted to the mounting unit 310, the protruding portion 220 of the toner bottle T is detected by the rotation detection sensor 203 in accordance with the rotation. That is, the CPU 701 causes the drive motor 604 to rotate the toner bottle T. The CPU 701 can determine that the toner bottle T is mounted to the mounting unit 310 when the output signal (rotation detection signal) from the rotation detection sensor 203 is changed from a low level to a high level.

Screen Display

FIG. 10A to FIG. 10C are diagrams for illustrating examples of a screen to be displayed on the display 707 of the operating device 706.

FIG. 10A is an illustration of an example of the warning screen displayed on the display 707 when the toner bottle T is removed from the mounting unit 310 with toner having an amount equal to or larger than a predetermined amount remaining in the toner bottle T. The warning screen includes information on the color of the toner contained in the removed toner bottle T and a message for prompting the user to reattach the removed toner bottle T to the mounting unit 310. The warning screen prevents the user from erroneously replacing the toner bottle T that does not require replacement. The warning screen corresponds to a guidance for prompting the user to reattach the toner bottle T removed from the mounting unit 310. With the amount of the toner in the toner bottle T being smaller than the predetermined amount, the image forming apparatus 200 in this embodiment avoids displaying the warning screen even when the toner bottle T is removed from the mounting unit 310.

FIG. 10B is an illustration of an example of the warning screen displayed on the display 707 when the toner bottle T is replaced by another toner bottle T' with the toner having an amount equal to or larger than the predetermined amount remaining in the toner bottle T. The warning screen includes information on the color of the toner contained in the removed toner bottle T that has been replaced with the toner having an amount equal to or larger than the predetermined amount remaining therein and a message for prompting the user to replace the toner bottle T' mounted to the mounting unit 310 by the toner bottle T removed last time. The warning screen can inform the user that the toner having an amount equal to or larger than the predetermined amount remains in the replaced toner bottle T. Therefore, the warning screen allows wasteful disposal of toner to be suppressed.

The CPU 701 acquires the identification information on the toner bottle T from the memory 223 after the toner bottle T is mounted to the mounting unit 310. The CPU 701 stores the acquired identification information in the RAM 703. After the toner bottle T is removed with the toner having an amount equal to or larger than the predetermined amount remaining therein, the CPU 701 compares the identification information on the toner bottle T' mounted to the mounting unit 310 with the identification information stored in the RAM 703. This allows the CPU 701 to detect that another toner bottle T' has been mounted. When the identification information differs, the CPU 701 can determine that the toner bottle T has been replaced by another toner bottle T' with the toner having an amount equal to or larger than the predetermined amount remaining in the toner bottle T.

FIG. 10C is an illustration of an example of the unmounted state alert screen displayed on the display 707 when the door 26 is closed without any toner bottle T being mounted to the mounting unit 310. The unmounted state alert screen includes a message for prompting the user to mount the toner bottle T to the mounting unit 310.

Screen Display Control

After the main power source of the image forming apparatus 200 is turned on, the CPU 701 uses the reader 224 to acquire the replenishment information from the memory 223 of the toner bottle T mounted to the mounting unit 310. The CPU 701 stores the replenishment information in the RAM 703.

The CPU 701 starts the screen display control processing when the detection result (opening/closing detection signal) from the door opening/closing switch 27 is changed from a low level to a high level with an amount of the toner in the toner bottle T being equal to or larger than the predetermined amount. For example, the CPU 701 determines whether or not the amount of the toner in the toner bottle T is equal to or larger than the predetermined amount based on the number of rotations of the toner bottle T. That is, the CPU 701 determines that the amount of the toner in the toner bottle T is equal to or larger than the predetermined amount when the number of rotations of the toner bottle T is smaller than a predetermined number. The toner bottle T in this embodiment has a fixed amount of the toner discharged from the toner bottle T by one replenishment operation. Therefore, the CPU 701 can determine the amount of the toner remaining in the toner bottle T based on the number of rotations of the toner bottle T. The CPU 701 determines whether or not the toner bottle T mounted to the mounting unit 310 satisfies a replacement condition. For example, the CPU 701 determines that the replacement condition is satisfied when the number of rotations of the toner bottle T is equal to or larger than the predetermined number. When the number of rotations of the toner bottle T is smaller than the predetermined number, the CPU 701 determines that the replacement condition is not satisfied.

Figure 11:
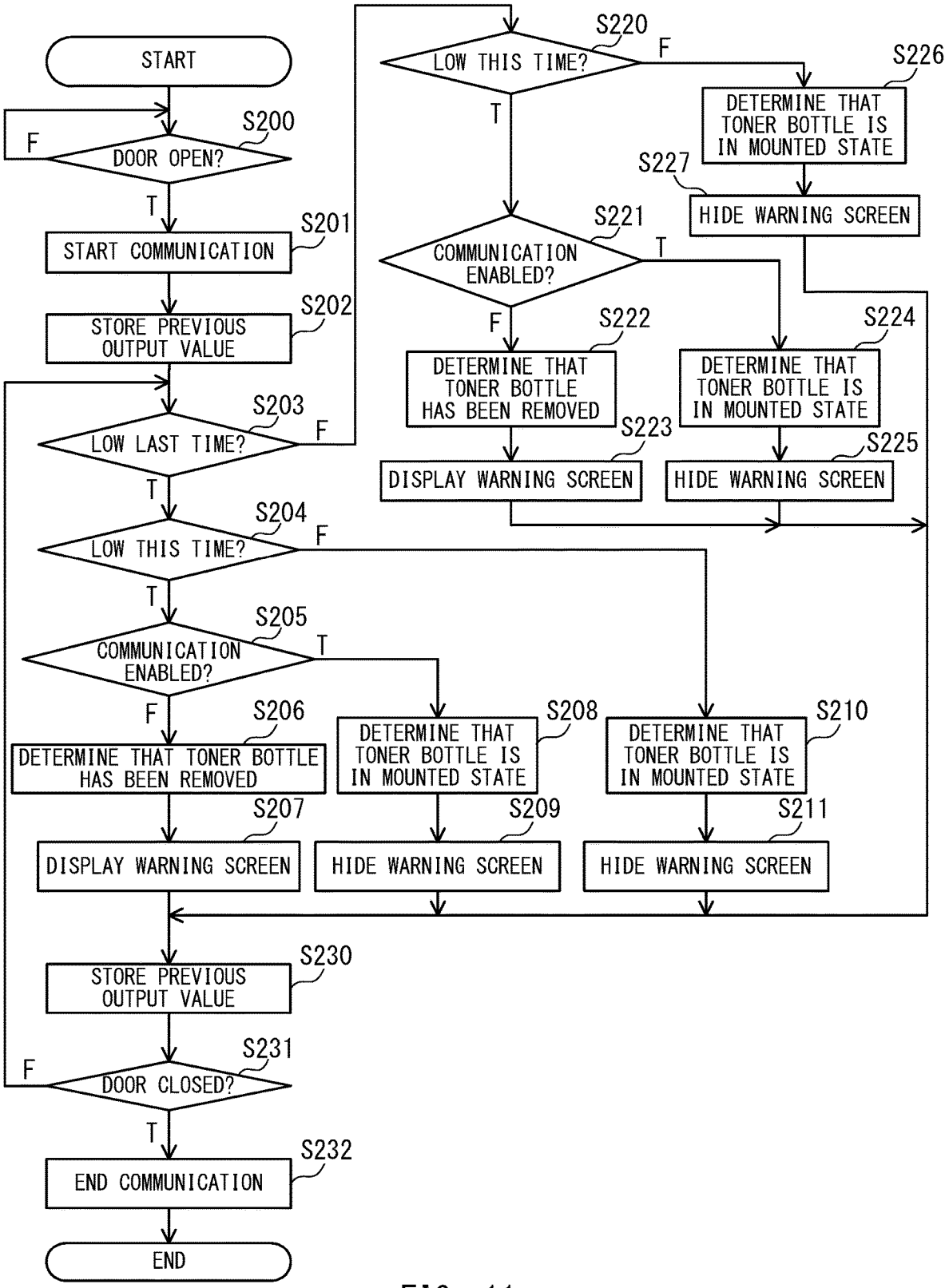
FIG. 11 is a flow chart for illustrating display control processing for a warning screen.

A description is given of the screen display control processing performed when the replacement condition for the toner bottle T is not satisfied with the number of rotations of the toner bottle T being smaller than the predetermined number. In this case, the warning screen to be display is the screen illustrated in FIG. 10A. FIG. 11 is a flow chart for illustrating display control processing for displaying the warning screen on the display 707. In FIG. 11, it is determined whether or not to display the warning screen illustrated in FIG. 10A. FIG. 12 is an explanatory table for showing a display state of the warning screen.

The CPU 701 determines whether or not the door 26 is in an open state (Step S200). The CPU 701 determines whether or not the door 26 is in an open state based on whether or not the opening/closing detection signal of the door opening/closing switch 27 is at a high level. The CPU 701 stands by until the door 26 is brought into an open state, that is, the opening/closing detection signal of the door opening/closing switch 27 is brought into a high level (F in Step S200). When the door 26 is in an open state with the opening/closing detection signal of the door opening/closing switch 27 being at a high level (T in Step S200), the CPU 701 starts communication between the reader 224 and the memory 223 of the toner bottle T (Step S201). In order to detect a change in output signal (rotation detection signal) of the rotation detection sensor 203, the CPU 701 stores the present output signal from the rotation detection sensor 203 in the RAM 703 as the previous output value (Step S202). The CPU 701 determines whether or not the previous output value from the rotation detection sensor 203 is at a low level (Step S203).

When the previous output value is at a high level (F in Step S203), the CPU 701 determines whether or not the present output signal from the rotation detection sensor 203 is at a low level (Step S220). When the present output signal from the rotation detection sensor 203 is at a high level (F in Step S220), the CPU 701 determines that the toner bottle T is in a mounted state (Step S226), and hides the warning screen (Step S227). When the present output signal from the rotation detection sensor 203 is at a low level (T in Step S220), the CPU 701 determines whether or not the communication between the reader 224 and the memory 223 of the toner bottle T is enabled (Step S221).

When determining that the communication between the reader 224 and the memory 223 of the toner bottle T is enabled (T in Step S221), the CPU 701 determines that there is a change in output signal from the rotation detection sensor 203 while the toner bottle T is mounted (Step S224). The CPU 701 determines that the toner bottle T has been rotated by the user, and hides the warning screen (Step S225).

When determining that the communication between the reader 224 and the memory 223 of the toner bottle T is disabled (F in Step S221), the CPU 701 determines that there is a change in output signal from the rotation detection sensor 203 without any toner bottle T being mounted (Step S222). When the user removes the toner bottle T, access made by the reader 224 is interrupted. The CPU 701 determines that the toner bottle T has been removed by the user, and displays the warning screen illustrated in FIG. 10A on the display 707 (Step S223).

When the previous output value is at a low level (T in Step S203), the CPU 701 determines whether or not the present output signal from the rotation detection sensor 203 is at a low level (Step S204). When the present output signal from the rotation detection sensor 203 is at a high level (F in Step S204), the CPU 701 determines that the toner bottle T is in a mounted state (Step S210). In this case, the CPU 701 hides the warning screen (Step S211). When the present output signal from the rotation detection sensor 203 is at a low level (T in Step S204), the CPU 701 determines whether or not the communication between the reader 224 and the memory 223 of the toner bottle T is enabled (Step S205).

When determining that the communication between the reader 224 and the memory 223 of the toner bottle T is enabled (T in Step S205), the CPU 701 determines that the toner bottle T is mounted although there is no change in output signal from the rotation detection sensor 203 (Step S208). This corresponds to a case in which the rotation angle of the toner bottle T differs from a predetermined rotation angle as described above. The CPU 701 determines that the toner bottle T is in a mounted state, and hides the warning screen (Step S209).

When determining that the communication between the reader 224 and the memory 223 of the toner bottle T is disabled (F in Step S205), the CPU 701 determines that the toner bottle T is not mounted although there is no change in output signal from the rotation detection sensor 203 (Step S206). This corresponds to a case in which the toner bottle T has been removed while the rotation angle of the toner bottle T differs from a predetermined rotation angle. The CPU 701 determines that the toner bottle T has been removed by the user, and displays the warning screen illustrated in FIG. 10A on the display 707 (Step S207).

After determining whether to display or hide the warning screen, the CPU 701 stores the present output signal (rotation detection signal) of the rotation detection sensor 203 in the RAM 703 as the previous output value (Step S230). The CPU 701 repeatedly performs the processing from Step S203 to Step S231 when the opening/closing detection signal of the door opening/closing switch 27 is at a high level, that is, the door 26 is in an open state (F in Step S231). The CPU 701 repeatedly performs the processing from Step S203 to Step S231 until the door 26 is closed. When the opening/closing detection signal of the door opening/closing switch 27 is at a low level, that is, the door 26 is closed, the CPU 701 brings the communication between the reader 224 and the memory 223 of the toner bottle T to an end (T in Step S231, and Step S232). The end of the communication brings the display control processing for displaying the warning screen on the display 707 to an end.

In this manner, the output signal (rotation detection signal) from the rotation detection sensor 203 and the state of the communication between the reader 224 and the memory 223 of the toner bottle T are combined with each other, to thereby allow the CPU 701 to correctly determine the mounted state of the toner bottle T and the rotation or removal thereof. With this configuration, it is possible to prevent the warning screen from being unnecessarily displayed even with the toner bottle T being in a mounted state without adding a new sensor for detecting that the toner bottle T is mounted to the mounting unit 310.

Figure 13:
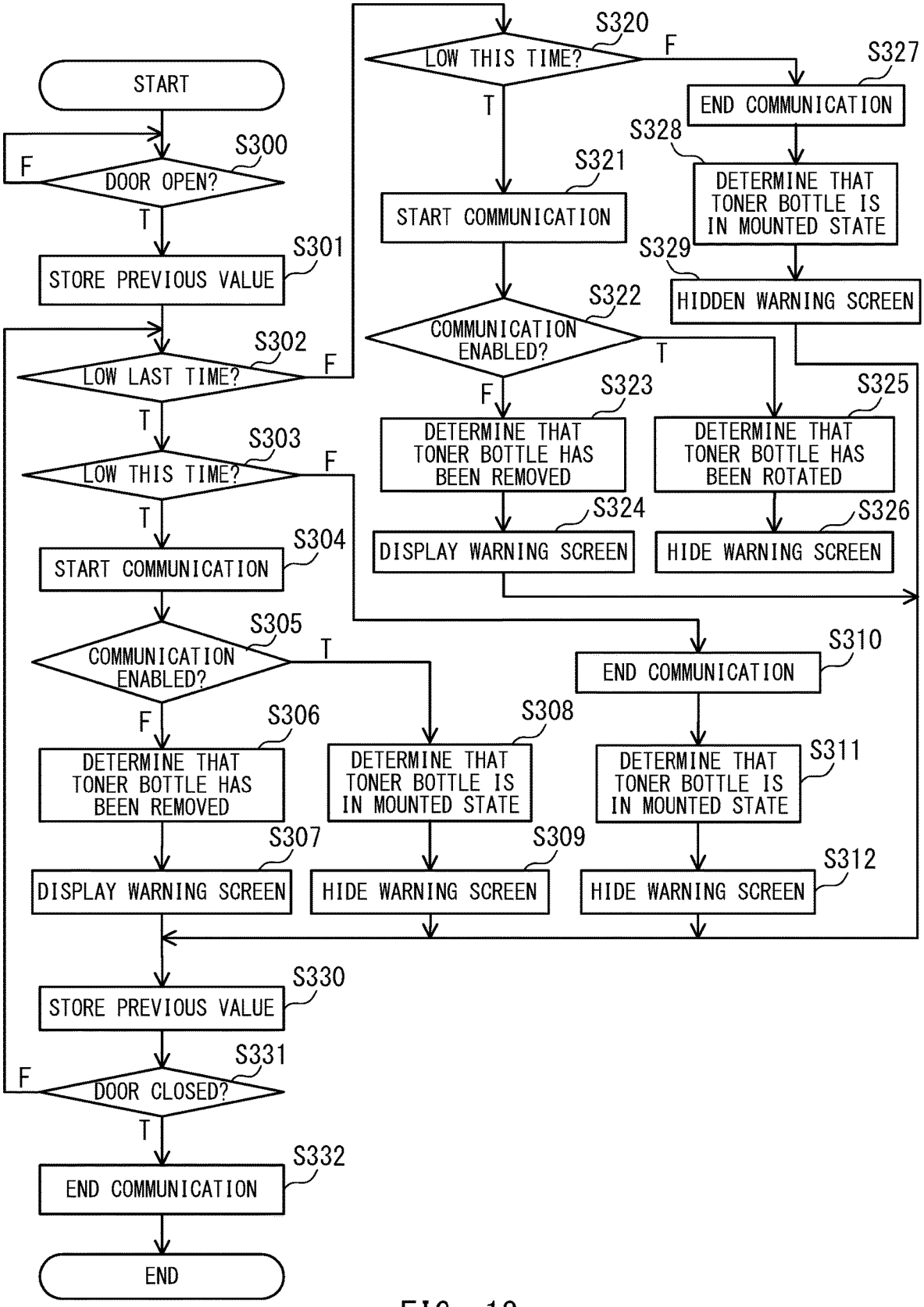
FIG. 13 is another flow chart for illustrating the display control processing for the warning screen.

FIG. 13 is another flow chart for illustrating the display control processing for displaying the warning screen on the display 707. This processing is screen display control processing performed when the replacement condition for the toner bottle T is not satisfied in the same manner as in FIG. 11. In FIG. 13, it is determined whether or not to display the warning screen illustrated in FIG. 10A. FIG. 12 is the explanatory table for showing the display state of the warning screen. In the above-mentioned processing illustrated in FIG. 11, when the door 26 is open, the CPU 701 unnecessarily performs communication in order to continue the communication to/from the memory 223 of the toner bottle T. In the processing illustrated in FIG. 13, the processing that suppresses communication to a minimum is achieved.

The CPU 701 determines whether or not the door 26 is in an open state (Step S300). The CPU 701 determines whether or not the door 26 is in an open state based on whether or not the opening/closing detection signal of the door opening/closing switch 27 is at a high level. The CPU 701 stands by until the door 26 is brought into an open state, that is, the opening/closing detection signal of the door opening/closing switch 27 is brought into a high level (F in Step S300). As in the processing of Step S202 of FIG. 11, when the door 26 is in an open state with the opening/closing detection signal of the door opening/closing switch 27 being at a high level (T in Step S300), the CPU 701 stores the present output signal from the rotation detection sensor 203 in the RAM 703 as the previous output value (Step S301). The CPU 701 determines whether or not the previous output value from the rotation detection sensor 203 is at a low level (Step S302).

When the previous output value is at a high level (F in Step S302), the CPU 701 determines whether or not the present output signal from the rotation detection sensor 203 is at a low level (Step S320). When the present output signal from the rotation detection sensor 203 is at a high level (F in Step S320), in a case where communication is underway between the reader 224 and the memory 223 of the toner bottle T, the CPU 701 brings the communication to an end (Step S327). The CPU 701 determines that the toner bottle T is in a mounted state (Step S328), and hides the warning screen (Step S329).

When the present output signal from the rotation detection sensor 203 is at a low level (T in Step S320), the CPU 701 starts the communication between the reader 224 and the memory 223 of the toner bottle T (Step S321). The CPU 701 determines whether or not the communication between the reader 224 and the memory 223 of the toner bottle T is enabled (Step S322).

When determining that the communication between the reader 224 and the memory 223 of the toner bottle T is enabled (T in Step S322), the CPU 701 determines that there is a change in output signal from the rotation detection sensor 203 while the toner bottle T is mounted (Step S325). The CPU 701 determines that the toner bottle T has been rotated by the user, and hides the warning screen (Step S326).

When determining that the communication between the reader 224 and the memory 223 of the toner bottle T is disabled (F in Step S322), the CPU 701 determines that there is a change in output signal from the rotation detection sensor 203 without any toner bottle T being mounted (Step S323). The CPU 701 determines that the toner bottle T has been removed by the user, and displays the warning screen illustrated in FIG. 10A on the display 707 (Step S324).

When the previous output value is at a low level (T in Step S302), the CPU 701 determines whether or not the present output signal from the rotation detection sensor 203 is at a low level (Step S303). When the present output signal from the rotation detection sensor 203 is at a high level (F in Step S303), in a case where communication is underway between the reader 224 and the memory 223 of the toner bottle T, the CPU 701 brings the communication to an end (Step S310). The CPU 701 determines that the toner bottle T is in a mounted state (Step S311). The CPU 701 hides the warning screen (Step S312).

When the present output signal from the rotation detection sensor 203 is at a low level (T in Step S303), the CPU 701 starts the communication between the reader 224 and the memory 223 of the toner bottle T (Step S304). The CPU 701 determines whether or not the communication between the reader 224 and the memory 223 of the toner bottle T is enabled (Step S305).

When determining that the communication between the reader 224 and the memory 223 of the toner bottle T is enabled (T in Step S305), the CPU 701 determines that the toner bottle T is mounted although there is no change in output signal from the rotation detection sensor 203 (Step S308). This corresponds to a case in which the rotation angle of the toner bottle T differs from a predetermined rotation angle as described above. The CPU 701 determines that the toner bottle T is in a mounted state, and hides the warning screen (Step S309).

When determining that the communication between the reader 224 and the memory 223 of the toner bottle T is disabled (F in Step S305), the CPU 701 determines that the toner bottle T is not mounted although there is no change in output signal from the rotation detection sensor 203 (Step S306). This corresponds to a case in which the toner bottle T has been removed while the rotation angle of the toner bottle T differs from a predetermined rotation angle as described above. The CPU 701 determines that the toner bottle T has been removed by the user, and displays the warning screen illustrated in FIG. 10A on the display 707 (Step S307).

After determining whether to display or hide the warning screen, the CPU 701 stores the present output signal of the rotation detection sensor 203 in the RAM 703 as the previous output value (Step S330). The CPU 701 repeatedly performs the processing from Step S302 to Step S331 when the opening/closing detection signal of the door opening/closing switch 27 is at a high level, that is, the door 26 is in an open state (F in Step S331). The CPU 701 repeatedly performs the processing from Step S302 to Step S331 until the door 26 is closed. When the opening/closing detection signal of the door opening/closing switch 27 is at a low level, that is, the door 26 is closed, the CPU 701 brings the communication between the reader 224 and the memory 223 of the toner bottle T to an end (T in Step S331, and Step S332). The end of the communication brings the display control processing for displaying the warning screen on the display 707 to an end.

In this manner, in the processing illustrated in FIG. 13, only when the output signal from the rotation detection sensor 203 is at a low level, the communication between the reader 224 and the memory 223 of the toner bottle T is started. With this processing, the mounted state of the toner bottle T and the rotation or removal thereof can be detected while suppressing unnecessary communication to a level lower than in the case of the processing illustrated in FIG. 11. It is also possible to obtain the same effects as those of the processing illustrated in FIG. 11. That is, it is possible to prevent the warning screen from being unnecessarily displayed even with the toner bottle T being in a mounted state without adding a new sensor for detecting that the toner bottle T is mounted to the mounting unit 310.

In the processing illustrated in FIG. 11 and FIG. 13, the CPU 701 erases the warning screen from the display 707 after a lapse of a predetermined time period since the start of the display. The CPU 701 displays the warning screen on the display 707 again when determining again that the toner bottle T has been removed from the mounting unit 310 by determining that the door 26 has not been closed since the start of the display of the warning screen (F in Step S231 in FIG. 11 or F in Step S331 in FIG. 13).

In addition, when the toner bottle is reattached in response to the warning screen, the CPU 701 verifies whether or not the toner bottle is an original toner bottle. The CPU 701 causes the reader 224 to acquire the replenishment information from the memory 223 of the reattached toner bottle. The CPU 701 verifies whether or not the reattached toner bottle is the original toner bottle by comparing the identification information included in the replenishment information acquired at the previous mounting with the identification information included in the currently acquired replenishment information. When the reattached toner bottle is different from the original toner bottle, the CPU 701 displays another warning screen different from the warning screen displayed in FIG. 11 or FIG. 13 on the display 707. In this embodiment, the warning screen illustrated as an example in FIG. 10B is displayed in this case.

The CPU 701 of the image forming apparatus 200 may set a condition other than the number of rotations of the toner bottle T as the replacement condition for the toner bottle T. For example, when the amount of the toner in the developing device 100 remains below the predetermined amount even after the toner bottle T is rotated, the CPU 701 may determine that the replacement condition is satisfied.

As described above, according to this embodiment, the unnecessary warning display due to the erroneous detection of the mounted state of the container can be suppressed.

Further, the image forming apparatus described in this embodiment is not limited to the configuration including an intermediate transfer member. For example, the image forming apparatus may be configured to transfer the toner images on the photosensitive drums 1*a*, 1*b*, 1*c*, and 1*d* onto the recording material S without transferring the toner images onto the intermediate transfer belt 7.

Further, the image forming apparatus described in this embodiment is not limited to an image forming apparatus capable of forming a full-color image. For example, the image forming apparatus may be a monochrome printer configured to form only a black image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-126241, filed Jul. 2, 2018 which is hereby incorporated by reference herein in its entirety.

What is claimed is:

1. An image forming apparatus, comprising:

an image forming unit configured to form an image by using a developer;

a mounting unit to which a container is to be mounted, wherein the container contains a developer;

a motor;

a controller configured to control the motor to rotate the container mounted to the mounting unit, wherein the developer is replenished by rotating the container mounted to the mounting unit;

a sensor configured to detect a predetermined portion of the container, wherein the predetermined portion is arranged in a rotation direction of the container; and a communication unit configured to communicate with a memory of the container mounted to the mounting unit, wherein the controller is configured to control rotation of the container mounted to the mounting unit based on a detection result of the sensor; and wherein the controller is configured to determine the container was manually rotated without removing the container from the mounting unit based on the detection result of the sensor and a state of communication between the communication unit and the memory.

2. The image forming apparatus according to claim 1, further comprising:

a door, wherein the door is to be opened to mount the container to the mounting unit or remove the mounted container from the mounting unit;

wherein, in a case where a first state in which a communication between the communication unit and the memory is established changes to a second state in which the communication is not established after the door is opened, the controller determines that the mounted container is removed from the mounted unit.

3. The image forming apparatus according to claim 2, wherein, in a case where the door is closed, the controller determines, based on a detection result of the sensor, that the container is mounted to the mounting unit.

4. The image forming apparatus according to claim 2, wherein, after the door is opened, in a case where (i) the first detection result has been changed to the second detection result and (ii) communication between the communication unit and the memory is not established, the controller is configured to determine that the mounted container has been removed from the mounting unit.

5. The image forming apparatus according to claim 1, further comprising:

a door, wherein the door is to be opened to mount the container to the mounting unit or remove the mounted container from the mounting unit;

wherein, in a case where a first state in which a communication between the communication unit and the memory is established changes to a second state in which the communication is not established after the door is opened while the predetermined portion is not detected by the sensor, the controller determines the mounted container is removed from the mounted unit.

6. The image forming apparatus according to claim 1, wherein the container includes a pump configured to be expanded and contracted to change an internal pressure of the container, to thereby replenish the image forming unit with the developer in the mounted container.

7. The image forming apparatus according to claim 1, further comprising a display, wherein the controller is configured to control the display based on determining a result.

8. The image forming apparatus according to claim 1, further comprising a display, wherein the controller is configured to display a warning screen on the display in a case where an amount of the developer in the removed container is larger than a predetermined amount.

9. The image forming apparatus according to claim 1, wherein the controller, after the mounted container is rotated, controls the motor so that the predetermined portion is detected by the sensor when a rotation of the mounted container is stopped.

10. The image forming apparatus according to claim 1, wherein the controller controls the motor based on the detection result of the sensor so that a rotation speed of the mounted container is equal to a predetermined rotation speed.

* * * * *